US007662536B2

(12) United States Patent
Matsumura et al.

(10) Patent No.: US 7,662,536 B2
(45) Date of Patent: Feb. 16, 2010

(54) RESIN PARTICLE LIQUID DISPERSION FOR ELECTROSTATIC IMAGE DEVELOPING TONER, PRODUCTION PROCESS OF THE LIQUID DISPERSION, ELECTROSTATIC IMAGE DEVELOPING TONER, PRODUCTION PROCESS OF THE TONER, ELECTROSTATIC IMAGE DEVELOPER AND IMAGE FORMING METHOD

(75) Inventors: Yasuo Matsumura, Kanagawa (JP); Hirotaka Matsuoka, Kanagawa (JP); Hideo Maehata, Kanagawa (JP); Satoshi Hiraoka, Kanagawa (JP); Yuki Sasaki, Kanagawa (JP); Fumiaki Mera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 261 days.

(21) Appl. No.: 11/592,301

(22) Filed: Nov. 3, 2006

(65) Prior Publication Data

US 2007/0269732 A1 Nov. 22, 2007

(30) Foreign Application Priority Data

May 22, 2006 (JP) ..... 2006-141051

(51) Int. Cl.
*G03G 9/13* (2006.01)

(52) U.S. Cl. ..... 430/137.17; 430/137.14; 430/119.1

(58) Field of Classification Search ..... 430/114, 430/137.14, 137.17, 119.1
See application file for complete search history.

(56) References Cited

U.S. PATENT DOCUMENTS

| | | | | |
|---|---|---|---|---|
| 5,567,563 | A * | 10/1996 | Minami | 430/108.4 |
| 6,582,869 | B2 | 6/2003 | Daimon et al. | |
| 2002/0018952 | A1 | 2/2002 | Daimon et al. | |
| 2003/0162115 | A1 * | 8/2003 | Uchinokura et al. | 430/108.22 |
| 2003/0165760 | A1 * | 9/2003 | Higuchi et al. | 430/108.4 |
| 2005/0221214 | A1 | 10/2005 | Nagahama et al. | |

FOREIGN PATENT DOCUMENTS

| | | |
|---|---|---|
| CN | 1332393 A | 1/2002 |
| CN | 1677253 A | 10/2005 |
| JP | A 49-91231 | 8/1974 |
| JP | A 56-40868 | 4/1981 |
| JP | A 63-30863 | 2/1988 |
| JP | A 10-195185 | 7/1998 |
| JP | A 2001-42564 | 2/2001 |
| JP | A 2001-42568 | 2/2001 |
| JP | A 2002-351140 | 12/2002 |

OTHER PUBLICATIONS

M. Barrère et al., "Polyester Synthesis in Aqueous Miniemulsion", Polymer, vol. 44, pp. 2833-2841 (2003).

* cited by examiner

*Primary Examiner*—John L Goodrow
(74) *Attorney, Agent, or Firm*—Oliff & Berridge, PLC

(57) ABSTRACT

A resin particle liquid dispersion for an electrostatic image developing toner includes: a polycondensable resin obtained by polycondensing at least one selected from the group consisting of a polycondensable monomer, an oligomer of the polycondensable monomer and a prepolymer of the polycondensable monomer, wherein the resin particle liquid dispersion further comprises a compound having a solubility parameter of 8 or less.

14 Claims, No Drawings

RESIN PARTICLE LIQUID DISPERSION FOR ELECTROSTATIC IMAGE DEVELOPING TONER, PRODUCTION PROCESS OF THE LIQUID DISPERSION, ELECTROSTATIC IMAGE DEVELOPING TONER, PRODUCTION PROCESS OF THE TONER, ELECTROSTATIC IMAGE DEVELOPER AND IMAGE FORMING METHOD

BACKGROUND

1. Technical Field

The present invention relates to a resin particle liquid dispersion. More specifically, the present invention relates to a resin particle liquid dispersion suitably used as a binder resin of an electrostatic image developing toner, and a production method thereof. Furthermore, the present invention relates to an electrostatic image developing toner using the resin particle liquid dispersion, an electrostatic image developer, and an image forming method.

2. Related Art

Conventionally, a method of emulsifying and dispersing a polyester resin having an acidic group in water in the presence of a basic neutralizer, and aggregating and fusing the dispersed resin particles to produce a toner is known. Such a method has a problem in that a resin emulsified product having very high hydrophilicity is readily generated in water due to molecular weight distribution or acid value of the resin, and this hydrophilic component may remain in the toner or on the toner surface to easily allow for moisture adsorption or the like particularly at a high temperature and a high humidity, as a result, the toner is liable to cause reduction in the electric charge amount or generation of filming on a photoreceptor, an intermediate transfer material or the like, and in turn, the electrophotographic system is liable to cause reduction in the image density or deterioration of the image quality, such as background staining.

SUMMARY

According to an aspect of the invention, there is provided a resin particle liquid dispersion for an electrostatic image developing toner, which comprises:

a polycondensable resin obtained by polycondensing at least one selected from the group consisting of a polycondensable monomer, an oligomer of the polycondensable monomer and a prepolymer of the polycondensable monomer, wherein the resin particle liquid dispersion further comprises a compound having a solubility parameter of 8 or less.

DETAILED DESCRIPTION

The resin particle liquid dispersion for an electrostatic image developing toner of the present invention (in the present invention, sometimes simply referred to as a "resin particle liquid dispersion") is a resin particle liquid dispersion for an electrostatic image developing toner, comprising a polycondensable resin obtained by polycondensing at least one member selected from a polycondensable monomer and its oligomer and prepolymer, wherein the resin particle liquid dispersion comprises a compound having a solubility parameter of 8 or less.

In the present invention, a polycondensable monomer and its oligomer and prepolymer are collectively called a polycondensation component.

The resin particle liquid dispersion for an electrostatic image developing toner of the present invention can be obtained by adding a compound having a solubility parameter of 8 or less to the polycondensation component, polycondensing the mixture according to a direct polymerization method (bulk method), and dispersing the polycondensation product in an aqueous medium. By virtue of adding a compound having a solubility parameter of 8 or less to the polycondensation component, an effective dehydration reaction can be realized and the production of a hydrophilic component can be suppressed, as a result, when dispersed in an aqueous medium, a resin particle liquid dispersion having a desired particle diameter can be obtained. The resin particle liquid dispersion may also be obtained by polycondensing the polycondensation component, adding a compound having a solubility parameter of 8 or less before the dispersion in an aqueous medium, and dispersing the mixture in an aqueous medium.

Furthermore, the binder resin for the electrostatic developing toner of the present invention may also be obtained by emulsifying and dispersing the polycondensation component and a compound having a solubility parameter of 8 or less in an aqueous medium, and emulsion-polymerizing the resulting dispersion. The compound having a solubility parameter of 8 or less is preferably added to the polycondensation component before emulsification and dispersion in an aqueous medium, but the compound and the polycondensation component may also be individually emulsified and dispersed.

At this time, a catalyst described later is preferably added, and a sulfur acid is preferably used as the catalyst. The catalyst may be added to any one of the polycondensation component, the compound having a solubility parameter of 8 or less, and the aqueous medium, but is preferably added to the aqueous medium.

The polycondensation temperature is preferably from about 70 to about 150° C., more preferably from about 75 to about 130° C. The polycondensation temperature is preferably about 150° C. or less, because the resin particle liquid dispersion of the present invention can be obtained with low energy, and when it is about 70° C. or more, sufficiently high reactivity can be obtained and this is preferred. At this time, the polycondensation reaction is preferably performed in the presence of a catalyst described later, and the polycondensation reaction is more preferably performed by using a sulfur acid as the catalyst.

The present invention is described in detail below.

The compound having a solubility parameter of 8 or less and the polycondensation component, which are used in the resin particle liquid dispersion of the present invention, are described below.

<Compound Having Solubility Parameter of 8 or Less>

In the present invention, the resin particle liquid dispersion contains a compound having a solubility parameter (also called an SP value) of 8 or less (hereinafter, in the present invention, sometimes referred to as a "specific hydrophobic compound"). By virtue of containing a compound having a solubility parameter of 8 or less (specific hydrophobic compound), the polycondensation component can be effectively dehydrated and production of a hydrophilic component can be suppressed. Furthermore, a resin particle liquid dispersion having a desired particle diameter can be obtained with low energy and therefore, this is preferred. If the solubility parameter exceeds 8, the compound cannot exert an effective dehydrating activity.

The solubility parameter is 8 or less, preferably 7.8 or less, more preferably 7.5 or less, still more preferably 7.0 or less.

The solubility parameter means a value defined by the following formula (1). The SP value can be determined by utilizing the chemical composition, the evaporation heat, the refractive index, the kauri-butanol value, the surface tension and the like, but in the present invention, an SP value of Fedors calculated and determined from the chemical composition is used.

$$SP = \sqrt{\frac{\Delta E}{V}} = \sqrt{\frac{\sum_i \Delta ei}{\sum_i \Delta vi}} \quad (1)$$

In formula (1), SP represents a solubility parameter, ΔE represents a cohesive energy (cal/mol), V represents a molar volume ($cm^3$/mol), Δei represents an evaporation energy (cal/atom or atomic group) of the i-th atom or atomic group, Δvi represents a molar volume ($cm^3$/atom or atomic group) of the i-th atom or atomic group, and i represents an integer of 1 or more.

The SP value represented by formula (1) is conventionally determined to have a unit of $cal^{1/2}/cm^{3/2}$ and at the same time, is denoted by a dimensionless value. In the present invention, a value determined according to the above-described conventional practice is used and denoted by a dimensionless value.

For reference, in the case of converting the SP value into an SI unit ($J^{1/2}/m^{3/2}$), this may be attained by multiplying the value by 2046.

Examples of the specific hydrophobic compound having a solubility parameter of 8 or less include the following compounds. Examples of the compound having a solubility parameter of 8 or less include polyalkylenes, polysiloxanes and fluorinated carbons which may have a substituent. Examples of the substituent include a halogen atom and an alkyl group.

Specific examples of the compound include paraffin (SP value: 7.0), polyethylene (SP value: 8.0), polyisobutylene (SP value: 7.8), silicone resin (SP value: 7.0), and polytetrafluoroethylene resin (SP value: 6.2).

As for the specific hydrophobic compound having a solubility parameter (SP value) of 8 or less, it is effective that the compound is melted at the heating and mixing of the polycondensation component, particularly, the polycondensable monomer, and thereby dissolved in the polycondensation component, or the compound in the form of powder is finely dispersed and mixed in the polycondensation component, particularly, the polycondensable monomer.

The addition ratio of the compound to the polycondensation component is from about 0.01 wt % to less than about 50 wt %, preferably from about 0.1 wt % to less than about 20 wt %, per 100 wt % of the polycondensation component.

When the amount added is in the above-described range, not only the effect of suppressing the production of a hydrophilic component is obtained but also the effect of the specific hydrophobic compound on the characteristics (e.g., electric charging property) of the toner can be minimized and therefore, this is preferred.

<Polycondensation Component>

In the present invention, the resin particle liquid dispersion is obtained by polycondensing at least one member selected from a polycondensable monomer and its oligomer and prepolymer.

Among these, a polycondensable monomer is preferably used.

Examples of the polycondensable monomer used for the polycondensation include a polycarboxylic acid, a polyol and a polyamine. Examples of the polycondensable resin include a polyester and a polyamide, and in particular, a polyester obtained by using those containing a polycarboxylic acid and a polyol as polycondensable monomers is preferred.

In the present invention, the polycarboxylic acid includes an aliphatic, alicyclic or aromatic polycarboxylic acid and an alkyl ester thereof, and the polyol includes a polyhydric alcohol, an ester compound thereof, a hydroxycarboxylic acid and the like. The polyester resin and the polyamide resin each can be produced by performing polycondensation through a direct esterification reaction, a transesterification reaction or the like using the polycondensable monomer. In this case, the polyester resin polymerized may take any form of amorphous (amorphous-noncrystalline) polyester, crystalline polyester and the like, or a mixed form thereof.

Among these monomers, it is preferred in the present invention to use a dicarboxylic acid as the polyvalent carboxylic acid and a diol as the polyol.

The polycarboxylic acid used as the monomer for use in the polycondensation is a compound containing two or more carboxyl groups within one molecule. Out of these compounds, a divalent carboxylic acid is a compound containing two carboxyl groups within one molecule, and examples thereof include an oxalic acid, a succinic acid, a maleic acid, an adipic acid, a glutaric acid, a β-methyladipic acid, an azelaic acid, a sebacic acid, a suberic acid, a nonanedicarboxylic acid, a decanedicarboxylic acid, an undecanedicarboxylic acid, a dodecanedicarboxylic acid, a fumaric acid, a citraconic acid, a diglycolic acid, a glutaconic acid, an n-dodecylsuccinic acid, an n-dodecenylsuccinic acid, an isododecylsuccinic acid, an isododecenylsuccinic acid, an n-octylsuccinic acid, a cyclohexanedicarboxylic acid, a cyclohexane-3,5-diene-1,2-dicarboxylic acid, a malic acid, a citric acid, a hexahydroterephthalic acid, a malonic acid, a pimelic acid, a tartaric acid, a mucic acid, a phthalic acid, an isophthalic acid, a terephthalic acid, a tetrachlorophthalic acid, a chlorophthalic acid, a nitrophthalic acid, a p-carboxyphenylacetic acid, a p-phenylenediacetic acid, an m-phenylenediglycolic acid, a p-phenylenediglycolic acid, an o-phenylenediglycolic acid, a diphenylacetic acid, a diphenyl-p,p'-dicarboxylic acid, a naphthalene-1,4-dicarboxylic acid, a naphthalene-1,5-dicarboxylic acid, a naphthalene-2,6-dicarboxylic acid and an anthracene dicarboxylic acid. Examples of the polyvalent carboxylic acid other than the divalent carboxylic acid include a trimellitic acid, a pyromellitic acid, a naphthalenetricarboxylic acid, a naphthalenetetracarboxylic acid, a pyrenetricarboxylic acid and a pyrenetetracarboxylic acid. Other examples include their lower ester and acid chloride, but the present invention is not limited thereto. One of these polyvalent carboxylic acids may be used alone, or two or more species thereof may be used in combination. Furthermore, other than those aliphatic dicarboxylic acid and aromatic dicarboxylic acids, a dicarboxylic acid component having a double bond may also be contained.

In the production process of the polyester for use in the present invention, out of those polyvalent carboxylic acids, an azelaic acid, a sebacic acid, a 1,9-nonanedicarboxylic acid, a 1,10-decamethylenedicarboxylic acid, a 1,11-undecanedicarboxylic acid, a 1,12-dodecanedicarboxylic acid, a terephthalic acid, a trimellitic acid and a pyromellitic acid are preferably used. These polyvalent carboxylic acids are sparingly soluble or insoluble in water and therefore, an ester synthesis reaction advantageously proceeds in the liquid suspension resulting from dispersion of the polyvalent carboxylic acid in water.

The polyol as the monomer for use in the production process of the present invention is a compound containing two or more hydroxyl groups within one molecule. Out of these compounds, a divalent polyol is a compound having two hydroxyl groups within one molecule, and examples thereof include ethylene glycol, propylene glycol, butanediol, butenediol, neopentyl glycol, pentanediol, hexanediol, cyclohexanediol, cyclohexanedimethanol, diethylene glycol, triethylene glycol, dipropylene glycol, octanediol, nonanediol, decanediol, dodecanediol, polyethylene glycol, polypropylene glycol, polytetramethylene glycol, bisphenol A, bisphenol Z and hydrogenated bisphenol A. Examples of the polyol other than the divalent polyol include glycerin, pentaerythritol, hexamethylolmelamine, hexaethylolmelamine, tetramethylolbenzoguanamine and tetraethylolbenzoguanamine. One of these polyols may be used alone, or two or more species thereof may be used in combination.

In the production process of the polyester for use in the present invention, out of those polyols, a divalent polyol such as 1,8-octanediol, 1,10-decanediol and 1,12-dodecanediol is preferably used.

Such a polyol is sparingly soluble or insoluble in water and therefore, an ester synthesis reaction advantageously proceeds in the liquid suspension resulting from dispersion of the polyol in water.

Examples of the polyamide used for obtaining a polyamide include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine and 1,4-cyclohexanebis(methylamine).

Also, a noncrystalline resin or a crystalline resin can be easily obtained by the combination of these polycondensable monomers.

Examples of the polyvalent carboxylic acid used for obtaining a crystalline polyester include, out of the above-described carboxylic acids, an oxalic acid, a malonic acid, a succinic acid, a glutaric acid, an adipic acid, a pimelic acid, a suberic acid, an azelaic acid, a sebacic acid, an aliphatic dicarboxylic acid such as 1,9-nonanedicarboxylic acid, 1,10-decanedicarboxylic acid (1,10-decamethylenedicarboxylic acid), 1,12-dodecanedicarboxylic acid, 1,14-tetradecanedicarboxylic acid and 1,18-octadecanedicarboxylic acid, a sebacic acid, a maleic acid, a fumaric acid, a citraconic acid, an itaconic acid, a glutaconic acid, an n-dodecylsuccinic acid, an n-dodecenylsuccinic acid, an isododecylsuccinic acid, an isododecenylsuccinic acid, an n-octylsuccinic acid, an n-octenylsuccinic acid, and an acid anhydride, a lower ester or an acid chloride thereof. Also, a divalent or greater polyvalent carboxylic acid described later may be used in combination.

Examples of the diol used for obtaining a crystalline polyester include ethylene glycol, diethylene glycol, triethylene glycol, 1,2-propylene glycol, 1,3-propylene glycol, 1,4-butanediol, 1,4-butenediol, neopentyl glycol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosadecanediol, diethylene glycol, triethylene glycol, dipropylene glycol, polyethylene glycol, polypropylene glycol, polytetramethylene ether glycol, 1,4-cyclohexanediol, 1,4-cyclohexanedimethanol, dipropylene glycol, polyethylene glycol, polypropylene glycol, polytetramethylene glycol, bisphenol A, bisphenol Z, bisphenol C, bisphenol E, bisphenol F, bisphenol P, bisphenol S, bisphenol Z, bisphenol, naphthalene diol, adamantane diol, adamantane dimethanol and hydrogenated bisphenol A. Also, a dihydric or greater polyhydric alcohol may be used in combination. Examples thereof include glycol, pentaerythritol, hexamethylolmelamine, hexaethylolmelamine, tetramethylolbenzoguanamine and tetraethylolbenzoguanamine.

The above-described bisphenols preferably contain at least one alkylene oxide group. Examples of the alkylene oxide group include, but are not limited to, an ethylene oxide group, a propylene oxide group and a butylene oxide group. The alkylene oxide group is suitably ethylene oxide or propylene oxide, and the addition molar number thereof is preferably from 1 to 3. Within this range, the viscoelasticity and glass transition temperature of the polyester produced can be appropriately controlled for use as a toner.

Examples of the crystalline polycondensable resin include a polyester obtained by reacting 1,9-nonanediol and 1,10-decanedicarboxylic acid, a polyester obtained by reacting cyclohexanediol and adipic acid, a polyester obtained by reacting 1,9-nonanediol and sebacic acid, a polyester obtained by reacting 1,6-hexanediol and sebacic acid, a polyester obtained by reacting ethylene glycol and succinic acid, a polyester obtained by reacting ethylene glycol and sebacic acid, and a polyester obtained by reacting 1,4-butanediol and succinic acid. Among these, preferred are a polyester obtained by reacting 1,9-nonanediol and 1,10-decanedicarboxylic acid, a polyester obtained by 1,9-nonanediol and sebacic acid, and a polyester obtained by reacting 1,6-hexanediol and sebacic acid, but the present invention is not limited thereto.

As for the polyvalent carboxylic acid used for obtaining a noncrystalline polyester for use in the present invention, out of the above-described polyvalent carboxylic acid, examples of the dicarboxylic acid include a phthalic acid, an isophthalic acid, a terephthalic acid, a tetrachlorophthalic acid, a chlorophthalic acid, a nitrophthalic acid, a malonic acid, a mesaconic acid, a p-carboxyphenylacetic acid, a p-phenylenediacetic acid, an m-phenylenediglycolic acid, a p-phenylenediglycolic acid, an o-phenylenediglycolic acid, a diphenylacetic acid, a diphenyl-p,p'-dicarboxylic acid, a naphthalene-1,4-dicarboxylic acid, a naphthalene-1,5-dicarboxylic acid, a naphthalene-2,6-dicarboxylic acid, an anthracene dicarboxylic acid, a cyclohexanedicarboxylic acid, a cyclohexenedicarboxylic acid, a norbornene-2,3-dicarboxylic acid, an adamantanedicarboxylic acid and an adamantanediacetic acid, and examples of the polyvalent carboxylic acid other than the divalent carboxylic acid include a trimellitic acid, a pyromellitic acid, a naphthalenetricarboxylic acid, a naphthalenetetracarboxylic acid, a pyrenetricarboxylic acid and a pyrenetetracarboxylic acid. Also, those obtained by deriving an acid anhydride, an acid chloride, an ester or the like from the carboxyl group of these carboxylic acids may be used.

Among these polyvalent carboxylic acids, a terephthalic acid and a lower ester thereof, a diphenylacetic acid, a cyclohexanedicarboxylic acid and the like are preferably used. Incidentally, the lower ester means an ester of an aliphatic alcohol having a carbon number of 1 to 8.

Preferred examples of the polyol used for obtaining a noncrystalline polyester for use in the present invention include, out of the above-described polyols, polytetramethylene glycol, bisphenol A, bisphenol Z, bisphenol S, bisphenol, naphthalenediol, adamantanediol, adamantanedimethanol, hydrogenated bisphenol A and cyclohexanedimethanol.

For producing one species of the polycondensable resin, one species of the polyvalent carboxylic acid and one species of the polyol each may be used alone, one species of one monomer and two or more species of the other monomer may be used, or two or more species of each monomer may be used. Also, in the case of using a hydroxycarboxylic acid for producing one species of the polycondensable resin, one species of the hydroxycarboxylic acid may be used alone, two or more species thereof may be used, or a polyvalent carboxylic acid or a polyol may be used in combination.

The noncrystalline polycondensation resin is preferably a polycondensate of a 1 mol propylene oxide adduct (2 mol adduct in terms of both ends) of bisphenol A and a terephthalic acid, a polycondensate of a 1 mol ethylene oxide adduct (2 mol adduct in terms of both ends) of bisphenol A and a cyclohexanedicarboxylic acid, or a polycondensate of a 1 mol ethylene oxide adduct (2 mol adduct in terms of both ends) of bisphenol A and a phenylenediacetic acid.

In the present invention, in the case of using a crystalline polyester as the polycondensable resin, the crystalline melting point Tm is preferably from about 50 to about 120° C., more preferably from about 55 to about 90° C. When Tm is about 50° C. or more, this is advantageous in that the releasability can be enhanced and the offset can be reduced, and when Tm is about 120° C. or less, fixing can be achieved at a lower temperature and this is preferred.

Here, the melting point of the crystalline polyester resin can be measured by using a differential scanning calorimeter (DSC) and can be determined as a melt peak temperature of the input compensation differential scanning calorimetry prescribed in JIS K-7121:87 when the measurement is performed by elevating the temperature at a rate of 10° C./min from room temperature to 150° C. The crystalline resin sometimes shows a plurality of melt peaks but in the present invention, the maximum peak is regarded as the melting point.

In the case of using a noncrystalline polyester resin as the polycondensable resin, the glass transition point (Tg) of the noncrystalline polyester is preferably from about 40 to about 100° C., more preferably from about 50 to about 80° C. When Tg is in the above-described range, this is advantageous in that the binder resin itself exhibits good cohesive force in the high-temperature region, hot offset scarcely occurs at the fixing, satisfactory melting is effected, and the minimum fixing temperature is not easily elevated.

Here, the glass transition point of the noncrystalline resin means a value measured by the method prescribed in ASTM D3418-82 (DSC method).

In the present invention, the glass transition point can be measured, for example, according to the differential scanning calorimetry (DSC) by "DSC-20" (manufactured by Seiko Instruments & Electronics Ltd.). More specifically, about 10 mg of a sample is heated at a constant temperature rising rate (10° C./min), and the glass transition point can be determined from the intersection between the base line and the inclined line of the endothermic peak.

In the present invention, in the case of using a crystalline polyester resin as the polycondensable resin, the weight average molecular weight thereof according to the measurement of molecular weight by gel permeation chromatography (GPC) using the tetrahydrofuran (THF) soluble portion is preferably from about 1,000 to about 60,000, more preferably from about 1,500 to about 50,000, still more preferably from about 2,000 to about 40,000.

Also, in the case of using a noncrystalline polyester resin as the polycondensable resin, the weight average molecular weight thereof according to the measurement of molecular weight by gel permeation chromatography (GPC) using the THF soluble portion is preferably from about 1,000 to about 60,000, more preferably from about 3,000 to about 50,000, still more preferably from about 5,000 to about 40,000.

When the weight average molecular weight is in the above-described range, the offset resistance is enhanced and this is preferred.

In the present invention, the molecular weight of the resin can be determined by measuring the THF soluble matter in a THF solvent with use of TSK-GEL, GMH (produced by Tosoh Corp.) or the like and calculating the molecular weight based on the molecular weight calibration curve produced from a monodisperse polystyrene standard sample.

In the present invention, either a noncrystalline polyester resin or a crystalline polyester resin can be used as the polycondensable resin, but the polycondensable resin preferably contains at least a crystalline polyester resin. When a crystalline polyester is used as the polycondensable resin, both the sharp-melt property attributable to the crystalline resin and the image quality or low-temperature fixing property as the characteristic feature of the polyester can be obtained and this is preferred.

Also, one species of noncrystalline polyester resin and/or crystalline polyester containing the specific hydrophobic compound may be used alone, but it is preferred to use a plurality of species thereof in combination.

The ratio of the crystalline polyester resin and the noncrystalline polyester resin is preferably crystalline polyester:noncrystalline polyester=from 50:50 to 5:95, more preferably from 30:70 to 10:90.

Furthermore, a liquid dispersion of crystalline polyester resin particle and/or noncrystalline polyester resin particle not containing the specific hydrophobic compound may also be used in combination.

The term "crystalline" of the "crystalline polyester resin", as used in the present invention means that the differential scanning calorimetry (DSC) shows not stepwise change in the heat absorption but a distinct endothermic peak and specifically, the half-value width of the endothermic peak when measured at a temperature rising rate of 10° C./min is within 15° C. On the other hand, when the half-value width of the endothermic peak exceeds 15° C. or a distinct endothermic peak is not observed, this means that the resin is noncrystalline (amorphous).

The present invention may comprise, as a polycondensation step, a polymerization reaction of a polycarboxylic acid and a polyol, which are polycondensable monomers described above, with a previously produced oligomer and/or prepolymer. The prepolymer is not limited as long as it is a polymer capable of being dissolved or uniformly mixed in those monomers.

Furthermore, in the present invention, the binder resin may be a homopolymer of the polycondensation component described above, a copolymer comprising a combination of two or more monomers including the polycondensation component described above, or a mixture or graft polymer thereof or may have a partially branched or crosslinked structure.

A polyamide resin particle liquid dispersion may also be similarly produced by using a polyamine and a polyol as polycondensable monomers.

Examples of the polyamine used for obtaining a polyamide include ethylenediamine, diethylenediamine, 1,2-propanediamine, 1,3-propanediamine, 1,4-butanediamine, 1,4-butenediamine, 2,2-dimethyl-1,3-butanediamine, 1,5-pentanediamine, 1,6-hexanediamine, 1,4-cyclohexanediamine and 1,4-cyclohexanebis(methylamine).

In the present invention, an oligomer and/or prepolymer of the above-described polycondensable monomer may also be used as the polycondensation component.

In the present invention, the polycondensable resin is preferably a polycondensable resin obtained by the polycondensation of the polycondensation component, more preferably by the polycondensation of the polycondensable monomer, still more preferably by the polycondensation in the presence of a catalyst. In the present invention, a sulfur acid is preferably contained as the polycondensation catalyst. The polycondensation catalyst is described below.

<Catalyst>

In the present invention, it is preferred to use a sulfur acid as the polycondensation catalyst.

(Sulfur Acid)

The sulfur acid includes an inorganic sulfur acid and an organic sulfur acid. Examples of the inorganic sulfur acid include a sulfuric acid, a sulfurous acid and a salt thereof, and examples of the organic sulfur acid include sulfonic acids such as alkylsulfonic acid, arylsulfonic acid and salts thereof, and organic sulfuric acids such as alkylsulfuric acid, arylsulfuric acid and salts thereof.

The sulfur acid is preferably an organic sulfur acid, more preferably an organic sulfur acid having a surface activating effect. Incidentally, the acid having a surface activating effect is a compound which has a chemical structure comprising a hydrophobic group and a hydrophilic group, with at least a part of the hydrophilic group having an acid structure comprising a proton, and which fulfills both an emulsifying function and a catalyst function.

Examples of the organic sulfur acid having a surface activating effect include an alkylbenzenesulfonic acid, an alkylsulfonic acid, an alkyldisulfonic acid, an alkylphenolsulfonic acid, an alkylnaphthalenesulfonic acid, an alkyltetralinsulfonic acid, an alkylallylsulfonic acid, a petroleum sulfonic acid, an alkylbenzimidazolesulfonic acid, a higher alcohol ether sulfonic acid, an alkyldiphenylsulfonic acid, a long-chain alkylsulfuric acid ester, a higher alcohol sulfuric acid ester, a higher alcohol ether sulfuric acid ester, a higher fatty acid amide alkylol sulfuric acid ester, a higher fatty acid amide alkylated sulfuric acid ester, a sulfated fat, a sulfosuccinic acid ester, a resin acid alcohol sulfuric acid, and salt compounds of all of these sulfur acids. A plurality of these compounds may be used in combination, if desired. Among these compounds, a sulfonic acid having an alkyl or aralkyl group, a sulfuric acid ester having an alkyl or aralkyl group, and a salt compound thereof are preferred. The carbon number of the alkyl or aralkyl group is preferably 7 to 20. Specific examples of the organic sulfur acid include a dodecylbenzenesulfonic acid, a pentadecylbenzenesulfonic acid, an isopropylbenzenesulfonic acid, a comphorsulfonic acid, a p-toluenesulfonic acid, a monobutyl-phenylphenol sulfuric acid, a dibutyl-phenylphenol sulfuric acid, a dodecylsulfuric acid and a naphthenyl alcohol sulfuric acid. Such a sulfuric acid may have some functional group in its structure.

The amount used of the sulfur acid usable in the present invention is preferably from about 0.001 to about 40 wt %, more preferably from about 0.01 to about 20 wt %, based on the total weight of polycondensation components.

When the amount of the sulfur acid used is in the above-described range, this advantageously ensures that the particle can maintain stability in water and exhibit higher polycondensation reactivity and the toner can keep appropriate electric charge property.

Another polycondensation catalyst employed in general may also be used by itself or in combination with the above-described sulfur catalyst. Specific examples thereof include an acid having a surface activating effect, a metal catalyst, a hydrolase-type catalyst and a basic catalyst.

[Acid Having Surface Activating Effect]

Examples of the acid having a surface activating effect include various fatty acids, a higher alkylphosphoric acid ester, a resin acid, and salt compounds of all of these acids. A plurality of species thereof may be used in combination, if desired.

(Metal Catalyst)

Examples of the metal catalyst include, but are not limited to, an organic tin compound, an organic titanium compound, an organic titanium compound, an organic antimony compound, an organic beryllium compound, an organic strontium compound, an organic germanium compound, an organic tin halide compound and a rare earth-containing catalyst.

Specific examples of the effective rare earth-containing catalyst include those containing scandium (Sc), yttrium (Y), lanthanum (La) as the lanthanoid element, cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb) or lutetium (Lu). In particular, those having an alkylbenzenesulfonate, alkylsulfuric acid ester salt or triflate structure are effective. As for the triflate, examples of the structural formula include $X(OSO_2CF_3)_3$, wherein X is a rare earth element. X is preferably scandium (Sc), yttrium (Y), ytterbium (Yb) or samarium (Sm).

The lanthanoid triflate is described in detail in Journal of Synthetic Organic Chemistry, Japan, Vol. 53, No. 5, pp. 44-54.

In the case of using a metal catalyst as the catalyst, the content of the catalyst-originated metal in the obtained resin is preferably made to be about 10 ppm or less, more preferably about 7.5 ppm or less, more preferably about 5.0 ppm or less. Accordingly, a metal catalyst is preferably not used or even if used, the metal catalyst is preferably used in a very slight amount.

(Hydrolase-Type Catalyst)

The hydrolase-type catalyst is not particularly limited as long as it catalyzes an ester synthesis reaction. Examples of the hydrolase for use in the present invention include an esterase classified into EC (enzyme code) Group 3.1 (see, for example, Maruo and Tamiya (supervisors), Koso Handbook (Handbook of Enzyme), Asakura-Shoten (1982)), such as carboxyesterase, lipase, phospholipase, acetylesterase, pectinesterase, cholesterol esterase, tannase, monoacylglycerol lipase, lactonase and lipoprotein lipase; a hydrolase classified into EC Group 3.2 capable of acting on a glycosyl compound, such as glucosidase, galactosidase, glucuronidase and xylosidase; a hydrolase classified into EC Group 3.3, such as epoxide hydrase; a hydrolase classified into EC Group 3.4 capable of acting on a peptide bond, such as aminopeptidase, chymotrypsin, trypsin, plasmin and subtilisin; and a hydrolase classified into EC Group 3.7, such as phloretin hydrase.

Among those esterases, an enzyme of hydrolyzing a glycerol ester and isolating a fatty acid is called a lipase. The lipase is advantageous, for example, in that this enzyme shows high stability in an organic solvent, catalyzes an ester synthesis reaction with good efficiency and is inexpensive. Accordingly, from the aspect of yield and cost, a lipase is preferably used also in the present invention.

Lipases of various origins may be used, but preferred examples thereof include a lipase obtained from microorganisms of *Pseudomonas* group, *Alcaligenes* group, *Achromobacter* group, *Candida* group, *Aspergillus* group, *Rhizopus* group and *Mucor* group, a lipase obtained from plant seeds and a lipase obtained from animal tissues, and further include pancreatin and steapsin. Among these, preferred is a lipase originated in microorganisms of *Pseudomonas* group, *Candida* group and *Aspergillus* group.

(Basic Catalyst)

Examples of the basic catalyst include, but are not limited to, a general organic base compound, a nitrogen-containing basic compound, and a tetraalkylphosphonium or tetraarylphosphonium hydroxide such as tetrabutylphosphonium hydroxide. Examples of the organic base compound include ammonium hydroxides such as tetra-methylammonium hydroxide and tetraethylammonium hydroxide; and examples of the nitrogen-containing basic compound include amines (e.g., triethylamine, dibenzylmethylamine), pyridine, methylpyridine, methoxypyridine, quinoline, imidazole, a hydroxide, hydride or amide of alkali metals (e.g., sodium, potassium, lithium, cesium) or alkaline earth metals (e.g., calcium, magnesium, barium), and a salt of an alkali or alkaline earth metal with an acid, such as carbonate, phosphate, borate and carboxylate, or with a phenolic hydroxyl group.

Other examples include a compound with an alcoholic hydroxyl group, and a chelate compound with acetylacetone, but the present invention is not limited thereto.

The total amount of the catalyst added is preferably from about 0.001 to about 40 wt %, more preferably from about 0.01 to about 20 wt %, based on the polycondensation component, and one species or a plurality of species may be added at the above-described proportion.

When the total amount of the catalyst is in this range, sufficiently high polycondensation reactivity is ensured and at the same time, the reverse or side reaction can be advantageously suppressed.

<Polycondensation Reaction>

The polycondensation reaction is described below.

In the present invention, the binder resin can be obtained even by performing the polycondensation reaction at a temperature lower than the conventional reaction temperature. The reaction temperature is preferably from about 70 to about 150° C., more preferably from about 75 to about 130° C.

When the reaction temperature is about 70° C. or more, this is advantageous in that the reactivity does not decrease due to reduction in the solubility of the polycondensation component, preferably, polycondensable monomer, or in the catalytic activity and the increase of molecular weight is not inhibited. Also, when the reaction temperature is about 150° C. or less, production with low energy can be implemented or coloration of the resin or decomposition or the like of the produced polycondensable resin does not occur and this is preferred.

For reducing in total the production energy of resin and the production energy of toner, it is very important to avoid the conventional high energy consumption-type production process and produce the polycondensable resin at a low temperature of about 150° C. or less. The polycondensation reaction has been heretofore performed at a high temperature exceeding 200° C., and in order to perform the polymerization at a low temperature of about 150° C. or less, which is from several tens of ° C. to a hundred and several tens of ° C. lower than the conventional reaction temperature, a sulfur acid is suitably used, because the conventional metal catalyst such as Sn type and Ti type exhibits high catalytic activity particularly at 200° C. or more and the activity thereof is very low at a low temperature of 150° C. or less.

The catalytic activity or capacity of the sulfur acid decreases along the increase of temperature in the high temperature region of 160° C. or more, but by virtue of a reaction mechanism that the reaction proceeds starting from the nucleophilic addition of the catalyst acid, the sulfur acid exhibits high catalytic activity in the low polymerization temperature range from about 70° C. to about 150° C. and can be suitably used for the polycondensation reaction at 150° C. or less.

Also, from the aspect of mechanical strength, a resin produced by using a sulfur acid catalyst is superior to a resin produced by using a metal catalyst. In the case of a sulfur acid catalyst, the polymerization proceeds by the nucleophilic addition reaction mechanism and therefore, possibility of mingling of an impurity is low, whereas in the case of a resin produced by using a metal catalyst such as Sn type or Ti type, the catalyst metal is readily taken into the resin because of the reaction mechanism that an acid and an alcohol are aggregated on the catalyst metal surface. When a metal having electrical conductivity is taken into the resin, the electric charge of the resin is liable to leak out, and when such a resin is used for a toner and particularly when printing is performed under the high-temperature high-humidity condition, leakage of electric charge readily occurs and this causes a problem that the electric charge amount is decreased and background fogging resulting from scattering of a toner also into the non-image area is readily generated. Furthermore, the metal taken into the resin is liable to cause a microstructural defect or the like in the resin.

On the other hand, when a sulfur acid catalyst is used, this is advantageous in that such mingling of a metal element can be suppressed, the leakage of electric charge hardly occurs even under the high-temperature high-humidity condition, and the background fogging is less generated. Also in this respect, it is preferred to use a sulfur acid catalyst rather than a metal catalyst.

The polycondensation reaction may be performed by a general polycondensation process such as bulk polymerization, emulsion polymerization, in-water polymerization (e.g., suspension polymerization), solution polymerization and interface polymerization, but bulk polymerization and in-water polymerization are preferred.

In particular, a polycondensable resin is preferably obtained by directly polycondensing a polycondensable monomer in an aqueous medium.

(Bulk Polymerization)

In the case of bulk polymerization, the reaction may be performed under atmospheric pressured, but when the purpose is to increase the molecular weight of the obtained polyester molecule, general conditions such as reduced pressure or nitrogen stream can be employed.

In the present invention, when polycondensing a polycondensation component, preferably polycondensable monomer, by the bulk polymerization method, examples of the method include a method of adding a specific hydrophobic compound (a compound having an SP value of 8 or less) and, if desired, a catalyst to a polycondensation component, and performing the polycondensation; and a method of polycondensing a polycondensation component (preferably polycondensable monomer) preferably in the presence of a catalyst, and then adding a specific hydrophobic compound. Among these, a method of performing the polycondensation in the presence of a specific hydrophobic compound is preferred. By such a method, production of a particulate hydrophilic compound in a small amount can be suppressed. Also, a resin particle liquid dispersion for an electrostatic image developing toner, which is suitably usable for an electrostatic image developing toner with excellent particle diameter distribution, can be efficiently produced with low energy and this is preferred. In particular, when the polycondensation is performed in the presence of a specific hydrophobic compound, this is advantageous in that effective dehydration can be realized.

A polycondensable monomer is preferably used as the polycondensation component. As for the polycondensable monomer, a polycarboxylic acid and a polyol are preferably used, and a dicarboxylic acid and a diol are more preferably used. Furthermore, as described above, a sulfur acid is preferably used as the catalyst, and the polycondensation is preferably performed at about 150° C. or less.

In other words, a hydrophobic compound having a solubility parameter of 8 or less is preferably mixed at the time of directly polymerizing a polycondensable monomer at a low temperature of about 150° C. or less by using a sulfur acid (sulfur atom-containing Broensted acid) as the catalyst or at the time of emulsifying a polycondensed product in an aqueous medium at a low temperature of about 150° C. or less. It is more preferred to perform the direct polycondensation in the presence of a specific hydrophobic compound.

The thus-obtained polycondensable resin is emulsified and dispersed in an aqueous medium, whereby a resin particle liquid dispersion can be obtained.

The polycondensable resin is preferably emulsified and dispersed by adding a base (basic compound). The base is preferably added to the aqueous medium. The base is not particularly limited and a known base may be used, but examples thereof include sodium hydroxide, potassium hydroxide, ammonia and various amines. Among these, sodium hydroxide and ammonia are preferred.

The amount added of the base may be appropriately selected within the range of ensuring good dispersion in an aqueous medium but is preferably from about 0.001 to about 1 mol/liter, more preferably from about 0.01 to about 0.5 mol/liter.

That is, it is also preferred to add a hydrophobic compound having a solubility parameter of 8 or less to a polycondensable monomer, perform the polycondensation by using a sulfur acid as the catalyst, and then add a base to effect emulsification, thereby producing a resin particle liquid dispersion, or to polycondense a polycondensable monomer by using a sulfur acid as the catalyst, then mix a hydrophobic compound having a solubility parameter of 8 or less, and further add a base to effect emulsification, thereby producing a resin particle liquid dispersion.

Furthermore, it is also preferred to add an addition-polymerizable monomer described later, particularly, a vinyl-based monomer such as styrene or acrylic acid ester, to the obtained polycondensable resin and after emulsification and dispersion, polymerize the addition-polymerizable monomer by using a polymerization initiator, particularly, a radical polymerization initiator. In this case, the polymerization initiator may be dispersed before the emulsification and dispersion but is preferably added to the aqueous medium.

Also, after an addition-polymerizable monomer is added to a polycondensation component and the polycondensation in the presence of a catalyst and the emulsification and dispersion in an aqueous medium are performed, the addition polymerization may be performed by using a polymerization initiator.

By virtue of the addition-polymerization type polymer contained in the resin particle, production of a hydrophilic component can be suppressed and this is preferred.

(In-Water Polymerization)

The in-water polymerization method performed in an aqueous medium is described below.

Incidentally, the aqueous medium as used in the present invention means water or a mixed solvent containing about 50 wt % or more of water, in which a water-miscible organic solvent may be mixed with water. The proportion of water mixed in the mixed solvent is preferably from about 60 to about 100 wt %, more preferably from about 70 to about 100 wt %. Examples of the water-miscible organic solvent include ethyl alcohol, methyl alcohol, acetone and acetic acid, with ethyl alcohol being preferred. The aqueous medium is most preferably water, and the water is preferably soft water or ion exchanged water. One of these solvents may be used alone, or two or more species thereof may be used in combination.

In the present invention, the polymerization method in an aqueous medium is not particularly limited, but it is preferred to utilize a normal non-uniform system polymerization mode in an aqueous medium, such as suspension polymerization method, solution suspension method, miniemulsion method, microemulsion method, multistage swelling method and emulsion polymerization method including seed polymerization. In this case, as the production mode capable of achieving a most preferred particle diameter of 1 μm and at the same time, achieving efficient production, a polymerization method giving a sub-micron particle of 1 μm or less as the final form, such as miniemulsion method and microemulsion method, is more preferred, because the polycondensation reaction, particularly, final molecular weight or polymerization rate, is dependent on the final particle diameter.

Examples of the polymerization method in an aqueous medium for use in the present invention include a method of adding a polycondensation component (preferably polycondensable monomer), a compound having an SP value of 8 or less and if desired, a catalyst and the like, emulsifying and dispersing this mixture in an aqueous medium, and heating it with stirring to allow the polycondensation reaction to proceed, thereby obtaining a resin particle liquid dispersion. The heating temperature is, as described above, preferably from about 70 to about 150° C.

More specifically, examples of the polymerization method include a method where a specific hydrophobic compound such as paraffin and polyethylene wax, and a sulfur acid catalyst (e.g., DBSA (dodecylbenzenesulfonic acid)) are added to a mixture of polyvalent carboxylic acid and polyol which are polycondensable monomers, the resulting mixture is emulsified and dispersed in an aqueous medium, and the polycondensation is allowed to proceed with stirring under heating at about 150° C. or less as much as possible, thereby realizing a resin liquid dispersion.

It is also preferred to allow the polycondensation reaction to proceed to a certain extent before the emulsification and dispersion.

Furthermore, a resin particle liquid dispersion is also preferably obtained by further adding an addition-polymerizable monomer (preferably vinyl-based monomer) described later to a mixture containing at least a polycondensation component (preferably polycondensable monomer) and a compound having an SP value of 8 or less (specific hydrophobic compound), and after emulsifying, dispersing and polycondensing the resulting mixture in an aqueous medium, adding a polymerization initiator (preferably radical polymerization initiator) to polymerize the addition-polymerizable monomer.

The polymerization initiator may be added to the aqueous medium before polycondensation, for example, at the emulsification and dispersion, but is preferably added to the aqueous medium after the polycondensation.

More specifically, a method where a specific hydrophobic compound and a vinyl-based monomer such as styrene and acrylic acid ester are mixed with a polycondensable monomer, the mixture is emulsified in an aqueous medium and then polycondensed by using a sulfur acid as the catalyst, and the vinyl-based monomer is further polymerized by using a radial initiator to produce a resin particle liquid dispersion, is preferred.

When an addition-polymerizable monomer is added, the viscosity decreases at the time of emulsifying the mixture containing a polycondensation component and the emulsification is advantageously facilitated.

Also, when the resin particle liquid dispersion contains an addition-polymerization type polymer, production of a particulate hydrophilic compound in a small amount can be suppressed and this is preferred. Furthermore, a resin particle liquid dispersion suitably usable for an electrostatic image developer having a desired particle diameter can be advantageously produced with low energy and good efficiency.

When polycondensing a polycondensation component in an aqueous medium, the above-described materials are emulsified or dispersed by using, for example, mechanical shear or ultrasonic wave, and at this emulsification and dispersion, a surfactant, a polymer dispersant, an inorganic dispersant or the like may be added to the aqueous medium, if desired.

Examples of the surfactant used here include an anionic surfactant such as sulfuric ester salt type, sulfonate type and phosphoric ester type; a cationic surfactant such as amine salt type and quaternary ammonium salt type; and a nonionic surfactant such as polyethylene glycol type, alkylphenol ethylene oxide adduct type and polyhydric alcohol type. Among these, an anionic surfactant and a cationic surfactant are preferred. The nonionic surfactant is preferably used in combination with the above-described anionic surfactant or cationic surfactant. One of these surfactants may be used alone or two or more species thereof may be used in combination. Examples of the anionic surfactant include sodium dodecylbenzenesulfonate, sodium alkylnaphthalenesulfonate, sodium arylalkylpolyethersulfonate, sodium 3,3-disulfonediphenylurea-4,4-diazo-bis-amino-8-naphthol-6-sulfonate, o-carboxybenzene-azo-dimethylaniline, sodium 2,2,5,5-tetramethyl-triphenylmethane-4,4-diazo-bis-β-naphthol-6-sulfonate, sodium dialkylsulfosuccinate, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate and calcium oleate; examples of the cationic surfactant include alkylbenzenedimethylammonium chloride, alkyltrimethylammonium chloride and distearylammonium chloride; examples of the nonionic surfactant include a polyethylene oxide, a polypropylene oxide, a combination of polypropylene oxide and polyethylene oxide, an ester of polyethylene glycol and higher fatty acid, an alkylphenol polyethylene oxide, an ester of higher fatty acid and polyethylene glycol, an ester of higher fatty acid and polypropylene oxide, and a sorbitan ester; examples of the polymer dispersant include sodium polycarboxylate and polyvinyl alcohol; and examples of the inorganic dispersant include calcium carbonate, but the present invention is in no way limited thereto. Furthermore, higher alcohols as represented by heptanol and octanol, or higher aliphatic hydrocarbons as represented by hexadecane, may also be blended as a stabilization aid so as to prevent the Ostwald ripening phenomenon of the monomer emulsion particle in an aqueous medium.

In the present invention, as described above, the polycondensation reaction may be performed in the presence of an addition-polymerizable monomer, or an addition-polymerizable monomer may be mixed after the polycondensation reaction. By finally performing the addition polymerization of the addition-polymerizable monomer, a composite particle of polycondensable resin and addition-polymerization type polymer can be obtained.

The addition-polymerizable monomer which can be used in the present invention includes a radical polymerizable monomer, a cationic polymerizable monomer and an anionic polymerizable monomer, and a radical polymerizable monomer is preferred.

The amount of the addition-polymerizable monomer added is preferably from about 0.1 to about 200 parts by weight, more preferably from about 1.0 to about 100 parts by weight, per 100 parts by weight of the polycondensable resin or polycondensation component. When the amount of the addition-polymerizable monomer added is in this range, the electric charge amount can be easily controlled and this is preferred.

Specific examples of the radical polymerizable monomer include vinyl aromatics such as styrene, α-substituted styrene (e.g., α-methylstyrene, α-ethylstyrene), nucleus-substituted styrene (e.g., m-methylstyrene, p-methylstyrene, 2,5-dimethylstyrene), and nucleus-substituted halogenated styrene (e.g., p-chlorostyrene, p-bromostyrene, dibromostyrene); unsaturated carboxylic acids such as (meth)acrylic acid (the term "(meth)acryl" as used herein means acryl and methacryl; hereinafter the same), crotonic acid, maleic acid, fumaric acid, citraconic acid and itaconic acid; unsaturated carboxylic acid esters such as methyl(meth)acrylate, ethyl(meth)acrylate, propyl (meth)acrylate, butyl(meth)acrylate (e.g., n-butyl (meth)acrylate, isobutyl (meth)acrylate), pentyl(meth)acrylate, hexyl(meth)acrylate, dodecyl(meth)acrylate, n-octyl (meth)acrylate, 2-ethylhexyl(meth)acrylate, glycidyl(meth) acrylate, benzyl (meth)acrylate, 2-chloroethyl(meth)acrylate, phenyl(meth)acrylate and α-chloromethyl(meth)acrylate; unsaturated carboxylic acid derivatives such as (meth) acrylaldehyde, (meth)acrylonitrile and (meth)acrylamide; N-vinyl compounds such as N-vinylpyridine and N-vinylpyrrolidone; vinyl esters such as vinyl formate, vinyl acetate, vinyl propionate, vinyl benzoate and vinyl butyrate; vinyl halide compounds such as vinyl fluoride, vinyl chloride, vinyl bromide and vinylidene chloride; vinyl ethers such as vinyl methyl ether, vinyl ethyl ether and vinyl isobutyl ether; an N-vinyl compound such as N-vinylpyrrole, N-vinylcarbazole, N-vinylindole and N-vinylpyrrolidone; N-substituted unsaturated amides such as N-methylol acrylamide, N-ethylol acrylamide, N-propanol acrylamide, N-methylol maleinamidic acid, N-methylol maleinamidic acid ester, N-methylol maleimide and N-ethylol maleimide; conjugated dienes such as butadiene and isoprene; polyfunctional vinyl compounds such as divinylbenzene, divinylnaphthalene and divinylcyclohexane; and polyfunctional acrylates such as ethylene glycol di(meth)acrylate, diethylene glycol di(meth)acrylate, propylene glycol di(meth)acrylate, tetramethylene glycol di(meth)acrylate, neopentyl glycol di(meth)acrylate, hexamethylene glycol di(meth)acrylate, trimethylolpropane di(meth)acrylate, trimethylolpropane tri(meth)acrylate, glycerol di(meth)acrylate, glycerol tri(meth)acrylate, pentaerythritol di(meth)acrylate, pentaerythritol tri(meth)acrylate, pentaerythritol tetra(meth)acrylate, dipentaerythritol di(meth) acrylate, dipentaerythritol tri(meth)acrylate, dipentaerythritol tetra(meth)acrylate, dipentaerythritol penta (meth)acrylate, dipentaerythritol hexa(meth)acrylate, sorbitol tri(meth)acrylate, sorbitol tetra(meth)acrylate, sorbitol penta(meth)acrylate and sorbitol hexa(meth)acrylate. Out of these monomers, N-substituted unsaturated amides, conjugated dienes, polyfunctional vinyl compounds and polyfunctional acrylates can also cause a crosslinking reaction in the produced polymer. These monomers may be used individually or in combination.

The radical polymerization initiator may be appropriately selected from known radial polymerization initiators.

Specific examples of the radical polymerization initiator include azobisnitriles such as 2,2'-azobis(2-methylpropionitrile), 2,2'-azobis(2-methylbutyronitrile), 2,2'-azobisisobutyronitrile, 2,2'-azobis(2,4-dimethylvaleronitrile), 2,2'-azobis(2,4-dimethyl-4-methoxyvaleronitrile), 1,1'-azobis(cyclohexanecarbonitrile) and 2,2'-azobis(2-amidinopropane) hydrochloride; organic peroxides such as diacyl peroxide (e.g., acetyl peroxide, octanoyl peroxide, 3,5,5-trimethylhexanoyl peroxide, decanoyl peroxide, lauroyl peroxide, benzoyl peroxide), dialkyl peroxide (e.g., di-tert-butyl peroxide, tert-butyl-α-cumyl peroxide, dicumyl peroxide), peroxy ester (e.g., tert-butyl peroxyacetate, α-cumyl peroxypivalate, tert-butyl peroxyoctoate, tert-butyl peroxyneodecanoate, tert-butyl peroxylaurate, tert-butyl peroxybenzoate, di-tert-butyl peroxyphthalate, di-tert-butyl peroxyisophthalate), hydroperoxide (e.g., tert-butyl hydroperoxide, 2,5-dimethylhexane-2,5-dihydroperoxide, cumene hydroperoxide, diisopropylbenzene hydroperoxide) and peroxy carbonate (e.g., tert-butyl peroxyisopropylcarbonate); inorganic peroxides such as hydrogen peroxide; and persulfates such as potassium persulfate, sodium persulfate and ammonium persulfate. Also, a redox polymerization initiator may be used in combination.

The polymerization initiator may be added a mixture containing a polycondensable monomer or a polycondensable resin, may be added to an aqueous medium or may be added to both thereof. Furthermore, the polymerization initiator may be added before emulsification dispersion or after emulsification dispersion.

In particular, after the polycondensation of an emulsified and dispersed solution containing a polycondensable monomer and an addition-polymerizable monomer, the polymerization initiator is preferably added to the aqueous medium.

The resin particle liquid dispersion for an electrostatic image developing toner of the present invention can be produced by the methods described above. Among those methods, the resin particle liquid dispersion is preferably obtained by mixing a polycondensable monomer, a specific hydrophobic compound and a catalyst, adding an addition-polymerizable monomer, emulsifying and dispersing the mixture in an aqueous medium, polycondensing it under heating, further adding a radical polymerization initiator, and polymerizing the addition-polymerizable monomer.

In the present invention, the median diameter of the resin particle in the resin particle liquid dispersion obtained as above is preferably from about 30 to about 500 nm, more preferably from about 50 to about 400 nm. When median diameter is in this range, a toner having a nearly uniform particle diameter distribution can be obtained and this is preferred.

The median diameter can be measured by a measuring device based on the dynamic light-scattering method (for example, LA920, manufactured by Horiba Ltd.).

In the resin particle liquid dispersion of the present invention, the particle size distribution of resin particles is preferably narrow. When the particle size distribution is narrow, this is advantageous in that a uniform resin particle can be obtained, as a result, the electrostatic image developing toner produced by using the resin particle liquid dispersion becomes homogeneous and exhibits good characteristics.

The particle size distribution is obtained by dividing the standard deviation of the particle diameter by the arithmetic mean value of the particle diameter and expressed in percentage (called a coefficient of variation). The particle size distribution is preferably about 50%, more preferably about 40%, still more preferably about 35% or less. When the particle size distribution is in the above-described range, this is advantageous in that the stability of the resin particle liquid dispersion is increased and at the toner formation, a toner having a more uniform particle size distribution is readily obtained.

In the present invention, it is also preferred to subject the resin particle liquid dispersion obtained as above to a centrifugal separation treatment and evaluate the resin particle dispersion.

More specifically, the centrifugal separation is preferably performed at about 10 to 30,000×g, more preferably from about 100 to 10,000×g, still more preferably from about 500 to 5,000×g. The treating time is preferably from about 2 minutes to 1 hour, more preferably from about 0.05 to 0.5 hours, still more preferably from about 0.05 to 0.25 hours.

The resin particle liquid dispersion of the present invention preferably causes no separation of the particle component under the above-described centrifugal separation conditions, and the median diameter of the supernatant component after the centrifugal separation treatment is preferably 0.05 μm or more. In such a resin particle liquid dispersion, the hydrophilic component of the resin particle is suppressed and at the same time, the low molecular weight component is effectively suppressed, so that improvement of environmental dependency of the electric charge property or suppression of filming can be advantageously achieved.

<Production Process of Toner>

In the present invention, the production process of a toner is preferably a production process of an electrostatic image developing toner, comprising a step of aggregating resin particles in a liquid dispersion containing at least a resin particle liquid dispersion to obtain an aggregate particle (aggregation step), and a step of heating and coalescing the aggregate particles (coalescence step). In this production process called an emulsion-polymerization aggregation method, the above-described resin particle liquid dispersion is preferably applied as a liquid dispersion having dispersed therein resin particles.

More specifically, a resin particle liquid dispersion for an electrostatic image developing toner obtained as above (resin particle liquid dispersion) is, if desired, mixed with a colorant particle liquid dispersion, a releasing agent particle liquid dispersion and the like, an aggregating agent is added to cause hetero-aggregation and thereby form an aggregate particle having a toner size, and the aggregate particles are fused and coalesced by heating to a temperature higher than the glass transition point or melting point of the resin particle, then washed and dried to obtain a toner.

Incidentally, as for the toner shape, those from amorphous to spherical are preferably used.

The aggregating agent is suitably a surfactant, an inorganic salt or a divalent or higher-valent metal salt. Particularly, when a metal salt is used, this is preferred in view of aggregation control and toner chargeability In the aggregation step, when the polycondensable resin particle in the resin particle liquid dispersion is prepared in an aqueous medium, the liquid dispersion may be used directly as the resin particle liquid dispersion. This resin particle liquid dispersion is mixed with a releasing agent particle liquid dispersion and, if desired, a colorant particle liquid dispersion and the like, and these particles are hetero-aggregated by adding an aggregating agent, whereby an aggregate particle having a toner size can be formed.

Also, a resin particle liquid dispersion having dispersed therein resin particles can be obtained by an arbitrary method such as a method where a resin particle polymer uniformly polymerized in advance by a solution polymerization method, a bulk polymerization method or the like is added together with a stabilizer in a solvent incapable of dissolving the polymer and mechanically mixed and dispersed.

For example, in the case where the resin dissolves in a solvent having relatively low solubility in water, the resin is dissolved in such a solvent, the resulting solution is dispersed as a particle together with an ionic surfactant or a polymer electrolyte such as polyacrylic acid in water by using a disperser such as homogenizer, and the solvent is then evaporated under heating or reduced pressure, whereby a resin particle liquid dispersion can be obtained.

Examples of the surfactant used here include an anionic surfactant such as sulfuric ester salt type, sulfonate type, phosphoric ester type and soap type; a cationic surfactant such as amine salt type and quaternary ammonium salt type; a nonionic surfactant such as polyethylene glycol type, alkyl phenol ethylene oxide adduct type and polyhydric alcohol type; and various graft polymers, but the surfactant is not particularly limited.

After forming a first aggregate particle by aggregating the resin particles in this way, the resin particle liquid dispersion of the present invention or another resin particle liquid dispersion may be further added to form a second shell layer on the surface of the first particle. In this example, a colorant liquid dispersion is separately prepared, but when a colorant is previously blended with the polycondensable resin particle, a colorant liquid dispersion is not necessary.

As for the aggregating agent, other than the surfactant, an inorganic salt or a divalent or higher-valent metal salt may be suitably used. In particular, when a metal salt is used, this is preferred in view of aggregation control and toner chargeability. Also, the above-described surfactant may be used, for example, for emulsion polymerization of resin, dispersion of pigment, dispersion of resin particle, dispersion of releasing agent, aggregation, or stabilization of aggregate particle.

As for the dispersing device, a general dispersing device such as rotary shear homogenizer and media-containing ball mill, sand mill or dynomill may be used.

In the present invention, the above-described aggregation method is not particularly limited, and an aggregation method conventionally employed in the emulsion-polymerization aggregation method of an electrostatic image developing toner, for example, a method of reducing the stability of emulsion by the elevation of temperature, change of pH, addition of salt, or the like, and stirring the emulsion with a disperser or the like, may be used.

After the aggregation treatment, for the purpose of, for example, suppressing the bleed-out of the colorant from the particle surface, a heat treatment or the like may be applied to thereby crosslink the particle surface. The surfactant and the like used may be removed by water washing, acid washing, alkali washing or the like, if desired.

In the production process of an electrostatic image developing toner of the present invention, various known internal additives such as electric charge control agent, antioxidant and ultraviolet absorbent used for this type of toner may be used, if desired.

The electric charge control agent may be added at any time such as at the preparation of emulsified dispersion (oil phase), at the emulsification and dispersion, or at the aggregation. The electric charge control agent is preferably added in the form of an aqueous liquid dispersion or the like, and as for the amount of the electric charge control agent added, the electric charge control agent is preferably added to occupy from about 1 to about 25 parts by weight, more preferably from about 5 to about 15 parts by weight, per 100 parts by weight of the oil phase.

The oil phase as used herein indicates, in the case of bulk polymerization, a component containing at least a polycondensable resin and being emulsified and dispersed in an aqueous medium, and in the case of in-water polymerization, a component containing at least a polycondensation component and being emulsified and dispersed in an aqueous medium.

The electric charge control agent may be a known electric charge control agent, for example, a positive charging electric charge control agent such as nigrosine-based dye, quaternary ammonium salt-based compound, triphenylmethane-based compound, imidazole-based compound and polyamine-based resin, or a negative charging electric charge control agent such as metal (e.g., chromium, cobalt, aluminum, iron)-containing azo-based dye, metal (e.g., chromium, zinc, aluminum) salt or complex of hydroxy-carboxylic acid (e.g., salicylic acid, alkylsalicylic acid, benzilic acid), amide compound, phenol compound, naphthol compound and phenolamide compound.

<Releasing Agent>

Also, in the production process of an electrostatic image developing toner of the present invention, waxes as a releasing agent used for this type of toner may be used, if desired. In this case, the releasing agent may be added at any time such as at the preparation of the above-described oil phase, at the emulsification and dispersion or at the aggregation. The releasing agent is preferably added in the form of an aqueous liquid dispersion or the like, and as for the amount of the releasing agent added, the releasing agent is preferably added to occupy from about 1 to about 25 parts by weight, more preferably from about 5 to about 15 parts by weight, per 100 parts by weight of the oil phase.

In the present invention, a known component may be used as the releasing agent. Specific examples of such a releasing agent include an olefin-based wax such as low molecular weight polyethylene, low molecular weight polypropylene, copolymerized polyethylene, grafted polyethylene and grafted polypropylene; an ester-based wax having a long-chain aliphatic group, such as behenyl behenate, montanic acid ester and stearic acid ester; a vegetable wax such as hydrogenated castor oil and carnauba wax; a ketone having a long-chain alkyl group, such as distearyl ketone; a silicone-based wax having an alkyl group or a phenyl group; a higher fatty acid such as stearic acid; a higher fatty acid amide such as such as oleic acid amide and stearic acid amide; a long-chain fatty acid polyhydric alcohol such as pentaerythritol and a partial ester form thereof; a paraffin-based wax; and Fischer-Tropsch wax.

The releasing agent particle liquid dispersion preferably has a median diameter of about 1 μm or less, more preferably from about 0.1 to about 0.8 μm. When the median diameter of the releasing agent particle is in the above-described range, this is advantageous in that the particle size distribution as a toner can be easily controlled and the releasability at the fixing or the off-set generation temperature can be appropriately maintained.

The content of the releasing agent is preferably from about 5 to about 30 wt %, more preferably from about 5 to about 25 wt %, based on the total weight of solid contents constituting the toner. The releasing agent content is preferably in this range from the standpoint of ensuring releasability of the fixed image in an oil-less fixing system.

<Colorant>

The electrostatic image developing toner of the present invention also preferably contains a colorant.

Examples of the colorant for use in the toner of the present invention include various pigments such as carbon black, chrome yellow (C.I. No. 14090), Hansa Yellow, benzidine yellow, Threne Yellow, quinoline yellow (C.I. No. 47005), Permanent Orange GTR, pyrazolone orange, Vulcan Orange, Watchung Red, Permanent Red, Brilliant Carmine 3B, Brilliant Carmine 6B, DuPont Oil Red (C.I. No. 26105), pyrazolone red, Lithol Red, Rhodamine B Lake, Lake Red C, Rose Bengal (C.I. No. 45435), aniline blue (C.I. No. 50405), ultramarine blue (C.I. No. 77103), Calco Oil Blue (C.I. No. azoic Blue 3), methylene blue chloride (C.I. No. 52015), phthalocyanine blue (C.I. No. 74160), phthalocyanine green, Malachite Green Oxalate (C.I. No. 42000), titanium black and lamp black (C.I. No. 77266); and various dyes such as acridine type, xanthene type, azo type, benzoquinone type, azine type, anthraquinone type, thioindigo type, dioxazine type, thiazine type, azomethine type, indigo type, thioindigo type, phthalocyanine type, aniline black type, polymethine type, triphenylmethane type, diphenylmethane type, thiazine type, thiazole type, xanthene type and nigrosine type (C.I. No. 50415B). One of these colorants may be used alone, or two or more species thereof may be used in combination.

As for the method for dispersing the colorant, an arbitrary method, for example, a general dispersing method such as rotary shear homogenizer or media-containing ball mill, sand mill or dynomill may be used, and the dispersion method is not limited. The colorant particle may be added to a mixed solvent together with other particle components all at once or in parts at multiple stages.

The amount used of the colorant is preferably from about 0.1 to about 20 parts by weight, more preferably from about 0.5 to about 10 parts by weight, per 100 parts by weight of the toner.

The electrostatic image developing toner of the present invention may contain a magnetic material, if desired.

The magnetic material includes a metal exhibiting strong ferromagnetic property, such as iron (including ferrite and magnetite), cobalt and nickel, an alloy or compound containing such an element; an alloy which contains no ferromagnetic element but exhibits ferromagnetic property when subjected to an appropriate heat treatment, for example, an alloy called Heusler alloy containing manganese and copper, such as manganese-copper-aluminum and manganese-copper-tin; chromium dioxide; and others. For example, in the case of obtaining a black toner, magnetite which itself is black and also exerts a function as a colorant may be preferably used. In the case of obtaining a color toner, a magnetic material with less black tinting, such as metallic iron, is preferred. Some of these magnetic materials also fulfill a function as a colorant and in such a case, the magnetic material may be used to serve also as a colorant. The content of the magnetic material is, in the case of producing a magnetic toner, preferably from about 20 to about 70 parts by weight, more preferably from about 40 to about 70 parts by weight, per 100 parts by weight of the toner.

In the toner of the present invention, an inorganic particle is preferably mixed as a flowability enhancer or the like.

The inorganic particle for use in the present invention is a particle having a primary particle diameter of preferably about 5 nm to about 2 μm, more preferably from about 5 to about 500 nm. Also, the specific surface area by the BET method is preferably from about 20 to about 500 $m^2/g$. The proportion of the inorganic particle mixed in the toner is preferably from about 0.01 to about 5 wt %, more preferably from about 0.01 to about 2.0 wt %.

Examples of such inorganic powder include silica powder, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Among these, silica powder is preferred.

The silica powder as used herein means a powder having an Si—O—Si bond and includes both a silica powder produced by the dry process and a silica powder produced by the wet process. Also, the silica powder may be any of anhydrous silicon dioxide, aluminum silicate, sodium silicate, potassium silicate, magnesium silicate, zinc silicate and the like, but silica powder containing about 85 wt % or more of $SiO_2$ is preferred.

Specific examples of the silica powder include commercially available various silicas, but those having a hydrophobic group on the surface are preferred and examples thereof include ΔEROSIL R-972, R-974, R-805 and R-812 (all produced by Aerosil Co.), and Talax 500 (produced by Talco Co.). Other than these, for example, silica powder treated with a silane coupling agent, a titanium coupling agent, a silicon oil, a silicon oil having an amine in the side chain, or the like may be used.

<Electrostatic Image Developing Toner>

The toner obtained by the production process of an electrostatic image developing toner of the present invention preferably has an accumulated volume average particle diameter $D_{50}$ of about 3.0 to about 9.0 μm, more preferably from about 3.0 to about 7.0 μm, still more preferably from about 3.0 to about 5.0 μm. When $D_{50}$ is in the above-described range, this is advantageous in that high adhesive force and good developability are obtained and the resolution of image is excellent.

Also, the volume average particle size distribution index GSDv of the toner obtained is preferably about 1.30 or less. When GSDv is 1.30 or less, good resolution and less occurrence of toner flying, fogging or the like giving rise to image defect are ensured and this is preferred.

The accumulated volume average particle diameter $D_{50}$ and the average particle size distribution index can be measured by a measuring device such as Coulter Counter TAII, (manufactured by Nikkaki Co., Ltd.) and Multisizer II (manufactured by Nikkaki Co., Ltd.). An accumulated distribution of each of the volume and the number is drawn from the small diameter side with respect to the particle size range (channel) divided on the basis of particle size distribution, the particle diameter at 16% accumulation is defined as $D_{16V}$ by volume and $D_{16P}$ by number, the particle diameter at 50% accumulation is defined as $D_{50V}$ by volume and $D_{50P}$ by number, and the particle diameter at 84% accumulation is defined as $D_{84V}$ by volume and $D_{84P}$ by number. Using these, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

In view of image forming property, the shape factor SF1 of the toner obtained is preferably from about 100 to about 140, more preferably from about 110 to about 135. The shape factor SF1 is determined as follows. An optical microscopic image of the toner scattered on a slide glass is input into a Luzex image analyzer through a video camera, SF1 is obtained for 50 or more toner particles, and the average value thereof is used as the shape factor. SF1 is defined by the following formula.

$$SF1 = \frac{(ML)^2}{A} \times \frac{\pi}{4} \times 100$$

wherein ML is an absolute maximum length of the toner particle, and A is a projected area of the toner particle.

The toner obtained is dried in the same manner as a normal toner and before use, for the purpose of imparting flowability and enhancing the cleaning property, an inorganic particle such as silica, alumina, titania and calcium carbonate, or a resin particle such as vinyl-based resin, polyester and silicone, may be added to the toner particle surface while applying shear in the dry state.

In the case of attaching the inorganic particle or resin particle to the toner surface in an aqueous medium, as for the inorganic particle, all materials usually employed as an external additive to the toner surface, such as silica, alumina, titania, calcium carbonate, magnesium carbonate and tricalcium phosphate, may be used by dispersing such a material with use of an ionic surfactant, a polymer acid or a polymer base.

<Electrostatic Image Developer>

The toner obtained by the production process of an electrostatic image developing toner of the present invention is used as an electrostatic image developer. This developer is not particularly limited as long as it contains the above-described electrostatic image developing toner, and may take an appropriate component composition according to the purpose. When the electrostatic image developing toner is used alone, a one-component system electrostatic image developer is prepared, and when the toner is used in combination with a carrier, a two-component system electrostatic image developer is prepared.

The carrier is not particularly limited, but examples of the carrier usually employed include a magnetic particle such as iron powder, ferrite, iron oxide powder and nickel; a resin-coated carrier obtained by coating the surface of a magnetic particle as a core material with a resin such as styrene-based resin, vinyl-based resin, ethylene-based resin, rosin-based resin, polyester-based resin and melamine-based resin or with a wax such as stearic acid to form a resin coat layer; and a magnetic material dispersion-type carrier obtained by dispersing magnetic particles in a binder resin. Among these, a resin-coated carrier is preferred because the toner chargeability or the resistance of the entire carrier can be controlled by the constitution of the resin coat layer.

The mixing ratio between the toner of the present invention and the carrier in the two-component system electrostatic image developer is usually from about 2 to about 10 parts by weight of toner per 100 parts by weight of carrier. The preparation method of the developer is not particularly limited, but examples thereof include a method of mixing the toner and the carrier by a V-blender or the like.

<Image Forming Method>

The electrostatic image developer (electrostatic image developing toner) may also be used for an image forming method in a normal electrostatic developing system (electrophotographic system). Preferred examples of the image forming method for use in the present invention include an image forming method comprising a latent image forming step of forming an electrostatic latent image on the surface of a latent image holding member, a development step of developing the electrostatic latent image formed on the surface of a latent image holding member with a toner-containing developer to form a toner image, a transfer step of transferring the toner image formed on the surface of a latent image holding member to the surface of a transferee member, and a fixing step of heat-fixing the toner image transferred to the surface of a transferee member, wherein the electrostatic image developing toner or the electrostatic image developer of the present invention is used as the toner. An image forming method arbitrarily comprising a cleaning step is also preferred.

The above-described steps in the image forming method of the present invention each is a general step itself and described, for example, in JP-A-56-40868 and JP-A-49-91231. Incidentally, the image forming method of the present invention may be performed by using a known image forming apparatus such as copying machine and facsimile machine.

The latent image forming step is a step of forming an electrostatic latent image on an electrostatic latent image carrying member. The toner image forming step is a step of developing the electrostatic latent image with a developer layer on a developer carrying member to form a toner image. The developer layer is not particularly limited as long as it contains the electrostatic image developer of the present invention containing the electrostatic image developing toner of the present invention. The transfer step is a step of transferring the toner image on a transfer material.

The toner image transferred is preferably fixed by a fixing step. In the fixing step, the fixing is preferably performed by applying a heat roller heated at a constant temperature to the transfer material. The time period for which the transfer material is contacted with the heat roller is preferably about 1 second or less, more preferably about 0.5 seconds or less. When the contact time is set to this range, high-speed fixing can be performed and this is preferred.

The cleaning step is a step of removing the electrostatic image developer remaining on the electrostatic latent image carrying member. In a preferred embodiment, the image forming method of the present invention further comprises a recycling step. The recycling step is a step of returning the electrostatic image developing toner recovered in the cleaning step to the developer layer. The image forming method in this embodiment comprising a recycling step can be implemented by using an image forming apparatus such as toner recycling system-type copying machine or facsimile machine. The image forming method of the present invention may also be applied to a recycling system where the cleaning step is omitted and the toner is recovered simultaneously with the development.

EXAMPLES

The present invention is described in greater detail below by referring to Examples, but the present invention is not limited to these Examples. In Examples, unless otherwise indicated, the "parts" is "parts by weight".

The method for measuring the glass transition point and the melting point, the method for measuring the weight average molecular weight Mw and the number average molecular weight Mn, and the method for evaluating the stability of the resin particle liquid dispersion for an electrostatic image developing toner, which are used in Examples, are described below.

<Measuring Method of Melting Point and Glass Transition Point>

The glass transition point (Tg) of the noncrystalline resin and the melting point (Tm) of the crystalline resin are measured and determined by using a differential scanning calorimeter (DSC50, manufactured by Shimadzu Corp.) at a temperature from room temperature to 150° C. under the condition of a temperature rising rate of 10° C./min. Incidentally, the glass transition point is defined as a temperature at the intersection between the extended lines of base line and rising line, and the melting point is defined as a temperature at the apex of the endothermic peak.

<Measuring Method of Weight Average Molecular Weight and Number Average Molecular Weight>

The values of the weight average molecular weight Mw and the number average molecular weight Mn as used in the present invention are determined by the following measuring method. That is, the weight average molecular weight Mw and the number average molecular weight Mn are measured by gel permeation chromatography (GPC) under the conditions described below.

The measurement is performed at a temperature of 40° C. by flowing a solvent (tetrahydrofuran) at a flow velocity of 1.2 ml/min, and injecting 3 mg as the sample mass of a tetrahydrofuran sample solution having a concentration of 0.2 g/20 ml. At the measurement of the molecular weight of a sample, the measurement conditions are selected such that the molecular weight of the sample is included in the range where a straight line is formed by the logarithm of molecular weight in the calibration curve prepared from several kinds of monodisperse polystyrene standard samples and the counted number.

In this connection, the reliability of the measurement results can be confirmed from the fact that an NBS706 polystyrene standard sample measured under the above-described conditions are found to have a weight average molecular weight $Mw=28.8\times10^4$ and a number average molecular weight $Mn=13.7\times10^4$. As for the column of GPC, any column may be employed as long as the above-described conditions are satisfied, but specifically, TSK-GEL, GMH (produced by Tosoh Corp.) is used.

<Measurement of Accumulated Volume Average Particle Diameter ($D_{50}$) and Volume Average Particle Size Distribution Index (GSDv)>

The accumulated volume average particle diameter and the volume average particle size distribution index are measured by using Coulter Counter Model TA-II (manufactured by Beckman Coulter Inc.) as the measuring device and ISOTON-II (produced by Beckman Coulter Inc.) as the electrolytic solution.

As for the measuring method, from 0.5 to 50 mg of a sample to be measured is added to 2 ml of a 5% aqueous solution of surfactant as the dispersant, preferably, sodium alkylbenzenesulfonate, the resulting solution is added to from 100 to 150 ml of the above-described electrolytic solution, the electrolytic solution having suspended therein the sample is subjected to a dispersion treatment for 1 minute by an ultrasonic disperser, the particle size distribution of particles having a particle diameter of 2 to 60 μm is measured by using an aperture having an aperture diameter of 100 μm of the Coulter Counter Model TA-II, and the volume average particle diameter and the volume average particle size distribution index (GSDv) are determined as described above. The number of particles measured is 50,000.

<Production of Crystalline Resin Particle Liquid Dispersion (C1)>

| | |
|---|---|
| p-Toluenesulfonic acid | 0.7 parts by weight |
| 1,6-Hexanediol | 59 parts by weight |
| Sebacic acid | 101 parts by weight |
| Polyethylene wax (Hi-Wax 200P, produced by Mitsui Chemicals, Inc., SP value: 8.0) | 8 parts by weight |

These components are mixed in a flask, and the mixture obtained is melted by heating at 120° C. with a mantle heater and held at 90° C. for 8 hours while degassing with stirring by a three-one motor, as a result, the contents became a viscous melt.

Similarly, an aqueous solution for neutralization prepared by dissolving 2.0 parts by weight of 1N NaOH in 650 parts by weight of ion exchanged water heated at 90° C. is charged into a flask and after emulsification for 5 minutes by a homogenizer (Ultra-Turrax, manufactured by IKA Works, Inc.), the flask is cooled with room-temperature water.

In this way, Crystalline Resin Particle Liquid Dispersion (C1) having a particle center diameter of 240 nm, a melting point of 69° C., a weight average molecular weight of 11,000, a number average molecular weight of 4,600 and a solid content amount of 20% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube. The solid content in the supernatant portion is small, but the median diameter is measured by LA920 and found to be 210 nm. At this time, the solid content amount is 0.2%.

<Production of Crystalline Resin Particle Liquid Dispersion (C2)>

| | |
|---|---|
| Dodecylbenzenesulfonic acid | 1.0 part by weight |
| Ion exchanged water | 1,000 parts by weight |
| These components are mixed and dissolved. | |
| 1,9-Nonanediol | 80 parts by weight |
| 1,10-Decamethylenedicarboxylic acid | 115 parts by weight |
| Paraffin Wax (HNP9, produced by Nippon Seiro Co., Ltd.; melting point: 70° C., SP value: 7.0) | 20 parts by weight |
| (Vinyl Monomers) | |
| Styrene | 25 parts by weight |
| n-Butyl acrylate | 7 parts by weight |
| Acrylic acid | 3 parts by weight |

These components are mixed, and the mixture is melted by heating at about 100° C. and charged into the aqueous dodecylbenzenesulfonic acid solution prepared above. The resulting solution is emulsified by a homogenizer (Ultra-Turrax, manufactured by IKA Works, Inc.) for 5 minutes and further emulsified in an ultrasonic bath for 5 minutes, and the emulsified product is kept at 80° C. in a flask with stirring in a nitrogen atmosphere and held for 8 hours in this state. Thereafter, 10 parts by weight of ion exchanged water having dissolved therein 0.35 parts by weight of ammonium persulfate as the radical polymerization initiator is added, and the resulting solution is further held at 80° C. for 5 hours.

In this way, Paraffin Wax-Containing Crystalline Resin Particle Liquid Dispersion (C2) having a particle center diameter of 220 nm, a melting point of 68° C., a weight average molecular weight of 7,500, a number average molecular weight of 2,800 and a solid content amount of 25% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube.

The solid content in the supernatant portion is small, but the median diameter is measured by LA920 and found to be 200 nm. At this time, the solid content amount is 0.35%.

| <Production of Crystalline Resin Particle Liquid Dispersion (C3)> | |
|---|---|
| p-Toluenesulfonic acid | 0.7 parts by weight |
| 1,6-Hexanediol | 59 parts by weight |
| Sebacic acid | 101 parts by weight |

These components are mixed in a flask, and the mixture obtained is melted by heating at 120° C. with a mantle heater and held at 90° C. for 8 hours while degassing with stirring by a three-one motor, as a result, the contents became a viscous melt.

Into this melt,

| | |
|---|---|
| Polyethylene wax (Hi-Wax 200P, produced by Mitsui Chemicals, Inc., SP value: 8.0) | 8 parts by weight |

is added, and this mixture is stirred by a three-one motor at 90° C. for 1 hour.

Similarly, an aqueous solution for neutralization prepared by dissolving 2.0 parts by weight of 1N NaOH in 650 parts by weight of ion exchanged water heated at 90° C. is charged into a flask and after emulsification for 5 minutes by a homogenizer (Ultra-Turrax, manufactured by IKA Works, Inc.), the flask is cooled with room-temperature water.

In this way, Crystalline Resin Particle Liquid Dispersion (C3) having a particle center diameter of 240 nm, a melting point of 69° C., a weight average molecular weight of 10,100, a number average molecular weight of 2,600 and a solid content amount of 20% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube. The median diameter in the supernatant portion is measured by LA920 and found to be 180 nm. At this time, the solid content amount is 2.2%.

| <Production of Crystalline Resin Particle Liquid Dispersion (C4)> | |
|---|---|
| 1,9-Nonanediol | 80 parts by weight |
| 1,10-Decamethylenedicarboxylic acid | 115 parts by weight |
| Paraffin Wax (HNP9, produced by Nippon Seiro Co., Ltd.; melting point: 70° C., SP value: 7.0) | 20 parts by weight |

These components are mixed in a flask, and the mixture obtained is melted by heating at 120° C. with a mantle heater and stirred by a three-one motor to obtain a viscous melt.

This melt is cooled to 90° C., and the following vinyl-based monomers are added thereto.

| (Vinyl-Based Monomers) | |
|---|---|
| Styrene | 25 parts by weight |
| n-Butyl acrylate | 7 parts by weight |
| Acrylic acid | 3 parts by weight |
| Dodecylbenzenesulfonic acid | 1.0 parts by weight |
| Ion exchanged water | 1,000 parts by weight |

A solution obtained by mixing and dissolving these components is prepared.

The melt is fused by heating at about 90° C. and charged into the aqueous dodecylbenzenesulfonic acid solution prepared above, the resulting solution is emulsified by a homogenizer (Ultra-Turrax, manufactured by IKA Works, Inc.) for 5 minutes and further emulsified in an ultrasonic bath for 5 minutes, and the emulsified product is kept at 80° C. in a flask with stirring in a nitrogen atmosphere and held for 8 hours in this state. Thereafter, 10 parts by weight of ion exchanged water having dissolved therein 0.35 parts by weight of ammonium persulfate as the radical polymerization initiator is added, and the resulting solution is further held at 80° C. for 5 hours.

In this way, Paraffin Wax-Containing Crystalline Resin Particle Liquid Dispersion (C4) having a particle center diameter of 240 nm, a melting point of 68° C., a weight average molecular weight of 8,100, a number average molecular weight of 3,700 and a solid content amount of 25% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube.

The solid content in the supernatant portion is small, but the median diameter is measured by LA920 and found to be 210 nm. At this time, the solid content amount is 0.25%.

| <Production of Crystalline Resin Particle Liquid Dispersion (C5)> | |
|---|---|
| Dodecylbenzenesulfonic acid | 1.0 part by weight |
| Ion exchanged water | 1,000 parts by weight |
| These components are mixed and dissolved. | |
| 1,9-Nonanediol | 80 parts by weight |
| 1,10-Decamethylenedicarboxylic acid | 115 parts by weight |
| Paraffin Wax (HNP9, produced by Nippon Seiro Co., Ltd.; melting point: 70° C., SP value: 7.0) | 20 parts by weight |

These components are mixed, and the mixture is melted by heating at about 100° C. and charged into the aqueous dodecylbenzenesulfonic acid solution prepared above. The resulting solution is emulsified by a homogenizer (Ultra-Turrax, manufactured by IKA Works, Inc.) for 5 minutes and further emulsified in an ultrasonic bath for 5 minutes, and the emulsified product is kept at 80° C. in a flask with stirring in a nitrogen atmosphere and held for 8 hours in this state.

In this way, Paraffin Wax-Containing Crystalline Resin Particle Liquid Dispersion (C5) having a particle center diameter of 300 nm, a melting point of 68° C., a weight average molecular weight of 5,800, a number average molecular weight of 2,300 and a solid content amount of 20% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube.

The solid content in the supernatant portion is small, but the median diameter is measured by LA920 and found to be 240 nm. At this time, the solid content amount is 0.45%.

<Production of Crystalline Resin Particle Liquid Dispersion (C6)>

Crystalline Resin Particle Liquid Dispersion (C6) is produced under the same conditions as Crystalline Resin Particle Liquid Dispersion (C1) except that the polyethylene wax is changed to stearyl stearate (produced by NOF Corp., SP value: 8.8).

In this way, Crystalline Resin Particle Liquid Dispersion (C6) having a particle center diameter of 240 nm, a melting point of 69° C., a weight average molecular weight of 11,200, a number average molecular weight of 4,800 and a solid content amount of 20% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube. The solid content in the supernatant portion is small, but the median diameter is measured by LA920 and found to be 220 nm. At this time, the solid content amount is 0.3%.

| <Production of Noncrystalline Resin Particle Liquid Dispersion (A1)> | |
|---|---|
| 1,4-Cyclohexanedicarboxylic acid | 175 parts by weight |
| 1 Ethylene oxide adduct of bisphenol A (2 mol adduct in terms of both ends) | 380 parts by weight |
| Dodecylbenzenesulfonic acid | 0.5 parts by weight |
| Polytetrafluoroethylene powder (MICROFRON II, produced by Powerhouse Accel Co., Ltd., 0.2 microns, SP value: 6.2) | 15 parts by weight |

These materials were mixed and charged into a reactor equipped with a stirrer, and polycondensation is performed at 120° C. for 10 hours in a nitrogen atmosphere, as a result, a uniform and transparent noncrystalline polyester resin is obtained. The weight average molecular weight by GPC is 13,000, and the glass transition temperature (on-set) is 56° C.

3.5 Parts by weight of styrene, 1.2 parts by weight of n-butyl acrylate and 0.3 parts by weight of acrylic acid are added as small-amount vinyl monomers to 95 parts by weight of the resin obtained above, thereby swelling the resin, and 0.5 parts by weight of soft-type sodium dodecylbenzenesulfonate is added as the surfactant. Furthermore, 300 parts by weight of ion exchanged water is added, and the resulting solution is heated at 80° C. and thoroughly mixed and dispersed by a homogenizer (Ultra-Turrax T50, manufactured by IKA Works, Inc.) in a glass-made round flask while heating.

Thereafter, the pH in the system is adjusted to 5.0 with 0.5 mol/liter of an aqueous sodium hydroxide solution, and the solution is further heated to 90° C. while continuing the stirring by the homogenizer to obtain Noncrystalline Resin Particle Emulsified Liquid Dispersion (A1).

In this way, Noncrystalline Resin Particle Liquid Dispersion (A1) having a particle center diameter of 210 nm and a solid content amount of 20% is obtained.

10 Parts by weight of this liquid dispersion is weighed in a glass test tube, set in an angle type rotor with 12 tubes, KOKUSAN H18, and centrifuged at 2,000×g for 30 minutes, as a result, a supernatant is produced in the upper part of the test tube.

The solid content in the supernatant portion is small, but the median diameter is measured by LA920 and found to be 180 nm. At this time, the solid content amount is 0.25%.

<Production of Noncrystalline Resin Particle Liquid Dispersion (A2)>

In the production of Noncrystalline Resin Particle Liquid Dispersion (A1), the polycondensation is performed without mixing the polytetrafluoroethylene powder to obtain a resin having a weight average molecular weight by GPC of 12,000, a number average molecular weight of 2,800 and a glass transition temperature (on-set) of 56° C. By performing the emulsification under the same conditions, Noncrystalline Resin Particle Liquid Dispersion (A2) having a particle center diameter of 200 nm and a solid content amount of 20% is produced.

This liquid dispersion (10 g) is weighed in a glass test tube, set in an angle type rotor with 12 tubes, KOKUSAN H18, and centrifuged at 2,000×g for 30 minutes, as a result, a supernatant is produced in the upper part of the test tube. The solid content in the supernatant portion is small, but the median diameter is measured by LA920 and found to be 90 nm. At this time, the solid content amount is 0.15%.

The physical properties of each of Resin Particle Liquid Dispersions (C1) to (C6), (A1) and (A2) produced above are shown in Table 1.

TABLE 1

| | SP Value | Center Diameter (nm) | Center Diameter (nm) after Centrifugation | Tg/Tm (° C.) | Weight Average Molecular Weight | Number Average Molecular Weight | Solid Content (%) | Solid Content (%) after Centrifugation |
|---|---|---|---|---|---|---|---|---|
| C1 | 8.0 | 240 | 210 | Tm: 69 | 11,000 | 4,600 | 20 | 0.2 |
| C2 | 7.0 | 220 | 200 | Tm: 68 | 7,500 | 2,800 | 25 | 0.35 |
| C3 | 8.0 | 240 | 180 | Tm: 69 | 10,100 | 2,600 | 20 | 2.2 |
| C4 | 7.0 | 240 | 210 | Tm: 68 | 8,100 | 3,700 | 25 | 0.25 |
| C5 | 7.0 | 300 | 68 | Tm: 68 | 5,800 | 2,300 | 20 | 0.45 |
| C6 | 8.8 | 240 | 220 | Tm: 69 | 11,200 | 4,800 | 20 | 0.3 |
| A1 | 6.2 | 210 | 180 | Tg: 56 | 13,000 | 5,500 | 20 | 0.25 |
| A2 | — | 200 | 90 | Tg: 56 | 12,000 | 2,800 | 20 | 0.15 |

| <Production of Releasing Agent Particle Liquid Dispersion (W1)> | |
|---|---|
| Anionic surfactant (Neogen R, produced by Dai-ichi Kogyo Seiyaku Co., Ltd.) | 2 parts by weight |
| Ion exchanged water | 800 parts by weight |
| Carnauba wax | 200 parts by weight |

These components are mixed and melted by heating at 100° C., and the resulting solution is emulsified by a homogenizer (Ultra-Turrax, manufactured by IKA Works, Inc.) for 5 minutes and further emulsified at 100° C. by using a Gaulin homogenizer.

In this way, Releasing Agent Particle Liquid Dispersion (W2) having a particle center diameter of 250 nm, a melting point of 83° C. and a solid content amount of 20% is obtained.

| <Preparation of Colorant Particle Liquid Dispersion (P1)> | |
|---|---|
| Cyan pigment (Copper Phthalocyanine B15:3, produced by Dainichiseika Color & Chemicals Mfg. Co., Ltd.) | 50 parts by weight |
| Anionic surfactant (Neogen R, produced by Dai-ichi Kogyo Seiyaku Co., Ltd.) | 5 parts by weight |
| Ion exchanged water | 200 parts by weight |

These components are mixed and dissolved, and the resulting solution is emulsified by a homogenizer (Ultra-Turrax, manufactured by IKA Works, Inc.) for 5 minutes and by an ultrasonic bath for 10 minutes to obtain Cyan Colorant Particle Liquid Dispersion (P1) having a center diameter of 190 nm and a solid content amount of 21.5%.

<Preparation of Colorant Particle Liquid Dispersion (P2)>

Magenta Colorant Particle Liquid Dispersion (P2) having a center diameter of 165 nm and a solid content amount of 21.5% is obtained in the same manner as in the preparation of Colorant Particle Liquid Dispersion (P1) except that in the preparation of Colorant Particle Liquid Dispersion (1), a magenta pigment (PR122, produced by Dai-Nippon Ink & Chemicals, Inc.) is used in place of the cyan pigment.

Example 1

| <Preparation of Toner Particle> | |
|---|---|
| Crystalline Resin Particle Liquid Dispersion (C1) | 105 parts by weight (resin: 21 parts by weight) |
| Noncrystalline Resin Particle Liquid Dispersion (A1) | 210 parts by weight (resin: 42 parts by weight) |
| Colorant Particle Liquid Dispersion (P1) | 40 parts by weight (pigment: 8.6 parts by weight) |
| Releasing Agent Particle Liquid Dispersion (W1) | 40 parts by weight (releasing agent: 8.0 parts by weight) |
| Polyaluminum chloride | 0.15 parts by weight |
| Ion exchanged water | 300 parts by weight |

These components are thoroughly mixed and dispersed by a homogenizer (Ultra-Turrax T50, manufactured by IKA Works, Inc.) in a stainless steel-made round flask, the resulting dispersion is heated to 42° C. by a heating oil bath while stirring the flask, and after holding at 42° C. for 60 minutes, 50 parts by weight (resin: 21 parts by weight) of Resin Particle Liquid Dispersion (A1) is added, followed by gentle stirring.

Thereafter, the pH in the system is adjusted to 6.0 with 0.5 mol/liter of an aqueous sodium hydroxide solution, and the resulting solution is heated to 85° C. while continuing the stirring.

The pH is kept from lowering to 5 or less by additionally adding dropwise the aqueous sodium hydroxide solution. After the completion of reaction, the reaction solution is cooled, filtered, thoroughly washed with ion exchanged water and then subjected to solid-liquid separation by Nutsche suction filtration. The solid fraction is redispersed in 3 liter of ion exchanged water at 40° C. and then washed by stirring at 300 rpm for 15 minutes. After repeating this washing operation 5 times, solid-liquid separation by Nutsche suction filtration is performed and subsequently, the solid fraction is vacuum-dried for 12 hours to obtain toner particles. The particle diameter of this toner particle is measured by a Coulter counter, as a result, the accumulated volume average particle diameter $D_{50}$ is 4.8 μm and the volume average particle size distribution index GSDv is 1.20. Also, the shape factor SF1 of the toner particle is determined by observing the shape with use of a Luzex image analyzer and found to be 128, indicating a potato-like shape.

<Preparation of External Addition Toner>

A silica ($SiO_2$) particle subjected to a surface hydrophobing treatment with hexamethyldisilazane (hereinafter sometimes simply referred to as "HMDS") and having an average primary particle diameter of 40 nm, and a metatitanic acid compound particle having an average primary particle diameter of 20 nm, which is a reaction product of metatitanic acid and isobutyltrimethoxysilane, are added each in an amount of 1 wt % and mixed in a Henschel mixer to produce a cyan external addition toner.

<Production of Carrier>

A methanol solution containing 0.1 part by weight of γ-aminopropyltriethoxysilane is added to 100 parts by weight of Cu—Zn ferrite particles having a volume average particle diameter of 40 μm and after coating the particles in a kneader, methanol is removed by distillation. The obtained silane compound is heated at 120° C. for 2 hours and thereby completely hardened. Subsequently, a perfluorooctylethyl methacrylate-methyl methacrylate copolymer (copolymerization ratio: 40:60) dissolved in toluene is added to the particles obtained above, and the resulting mixture is treated in a vacuum kneader to produce a resin-coated carrier in which the coverage of the perfluorooctylethyl methacrylate-methyl methacrylate copolymer is 0.5 wt %.

<Production of Developer>

5 Parts by weight of each of the toners produced as above is mixed with 100 parts by weight of the thus-obtained resin-coated carrier by a V-blender for 20 minutes to produce an electrostatic image developer. These developers are used as the developer in the following evaluations.

(Evaluation of Toner)

The developer prepared above is examined by using a modified machine of DocuCentre Color 500 manufactured by Fuji Xerox Co., Ltd., in a normal laboratory environment, as a result, the developability and fixing property both are good, and a good initial image quality (A) with high quality and no image defect is exhibited. Incidentally, the image quality is evaluated according to the following criteria.

A: Excellent (a clear and good image with absolutely no image defect (background staining, streaking)).

B: Good (despite slight image defect, no problem in practice)

C: Bad (conspicuous image defect and problematic in practice)

In the modified machine above, an idling test of developing machine is performed for 30 minutes in a laboratory environment under each of the high-temperature high-humidity condition of 30° C. and 80% (condition of summer environment) and the low-temperature low-humidity condition of 10° C. and 15% (condition of winter environment), and the electric charge amount is measured by a Toshiba blow-off electric charge amount meter and found to be −37 μC/g in the condition of summer environment and −43 μC/g in the condition of winter environment. The ratio of electric charge amount between these environments is 0.86, and good environmental stability is revealed.

The image quality is good in both the condition of summer environment and the condition of winter environment and not changed from the initial evaluation results in the laboratory.

Furthermore, a continuous printing test of 50,000 sheets is performed in the condition of summer environment, as a result, the image quality maintaining property is good and generation of filming or reduction of the toner chargeability is not recognized.

In Example 2, the toner is produced and evaluated in the same manner as in Example 1 except that Crystalline Resin Particle Liquid Dispersion (C1) is changed to (C2) and Colorant Particle Liquid Dispersion (P1) is changed to (P2).

In Example 3, the toner is produced and evaluated in the same manner as in Example 1 except that Crystalline Resin Particle Liquid Dispersion (C1) is changed to (C4).

In Example 4, the toner is produced and evaluated in the same manner as in Example 1 except that Crystalline Resin Particle Liquid Dispersion (C1) is changed to (C5).

In Example 5, the toner is produced and evaluated in the same manner as in Example 1 except that Crystalline Resin Particle Liquid Dispersion (C1) is changed to (C3) and a noncrystalline resin particle liquid dispersion is not used.

In Comparative Example 1, the toner is produced and evaluated in the same manner as in Example 1 except that Crystalline Resin Particle Liquid Dispersion (C1) is not used and Noncrystalline Resin Particle Liquid Dispersion (A1) is changed to (A2).

In Comparative Example 2, the toner is produced and evaluated in the same manner as in Example 5 except that Crystalline Resin Particle Liquid Dispersion (C3) is changed to (C6).

The results are shown in Table below.

TABLE 2

| | Example 1 | Example 2 | Example 3 | Example 4 | Example 5 | Comparative Example 1 | Comparative Example 2 |
|---|---|---|---|---|---|---|---|
| Kind of noncrystalline resin | A1 | A1 | A1 | A1 | none | A2 | none |
| Particle median diameter of supernatant after centrifugation in test tube (nm) | 180 | 180 | 180 | 180 | — | 90 | — |
| Kind of crystalline resin | C1 | C2 | C4 | C5 | C3 | none | C6 |
| Particle median diameter of supernatant after centrifugation in test tube (nm) | 210 | 200 | 240 | 300 | 180 | — | 220 |
| Kind of releasing agent | W1 | W1 | W1 | W1 | W1 | W1 | W1 |
| Colorant | P1 | P2 | P1 | P1 | P1 | P1 | P1 |
| $D_{50}$ (μm) | 4.8 | 4.5 | 4.8 | 4.3 | 4.1 | 5.1 | 4.2 |
| GSDv | 1.20 | 1.22 | 1.23 | 1.25 | 1.28 | 1.25 | 1.31 |
| SF1 | 128 | 132 | 130 | 126 | 120 | 125 | 120 |
| Electric charge amount in summer environment | −37 | −40 | −35 | −28 | −25 | −20 | −15 |
| Electric charge amount in winter environment | −43 | −49 | −49 | −34 | −41 | −60 | −37 |
| Ratio of electric charge amount between environments | 0.86 | 0.82 | 0.71 | 0.82 | 0.61 | 0.33 | 0.41 |
| Initial image quality | A | A | A | A | A | A | A |
| Image quality in summer environment | A | A | A | B | B | C | C |
| Image quality in winter environment | A | A | A | A | B | B | A |
| Image quality maintaining property by continuous printing test in summer environment | A | A | A | A | B | C | C |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents

What is claimed is:

1. A process for producing an electrostatic image developing toner, the process comprising:

(a) polycondensing at least one member selected from the group consisting of polycondensable monomers, oligomers of the polycondensable monomers, and prepolymers of the polycondensable monomers in the presence of a compound having a solubility parameter of 8 or less and at a temperature of from about 70° C. to 130° C.;

(b) emulsifying the polycondensed product in an aqueous medium to obtain a resin particle liquid dispersion;

(c) aggregating resin particles in a liquid dispersion comprising the resin particle liquid dispersion to obtain aggregate particles; and (d) heating and coalescing the aggregate particles to obtain an electrostatic image developing toner.

2. The process according to claim 1, wherein the toner comprises a releasing agent in an amount of from about 5 to about 30 wt % based on a total weight of solid contents constituting the toner.

3. The process according to claim 1, wherein the toner comprises a colorant in an amount of from about 0.1 to about 20 parts by weight per 100 parts by weight of the toner.

4. The process according to claim 1, wherein the toner has an accumulated volume average particle diameter $D_{50}$ of about 3.0 to about 9.0 μm.

5. The process according to claim 1, wherein the toner has a volume average particle size distribution index GSDv of about 1.30 or less.

6. The process according to claim 1, wherein the toner has a shape factor SF1 of from about 100 to about 140.

7. The process according to claim 1, wherein the compound has a solubility parameter of 7.0 or less.

8. The process according to claim 1, wherein the compound having a solubility parameter of 8.0 or less is selected from the group consisting of polyalkylenes, polysiloxanes, and fluorinated carbons that are unsubstituted or substituted.

9. The process according to claim 8, wherein the compound having a solubility parameter of 8.0 or less is substituted with at least one of a halogen atom and an alkyl group.

10. The process according to claim 1, wherein the compound having a solubility parameter of 8.0 or less is at least one member selected from the group consisting of paraffin having a solubility parameter of 7.0, polyethylene having a solubility parameter of 8.0, polyisobutylene having a solubility parameter of 7.8, silicon resin having a solubility parameter of 7.0, and polytetrafluoroethylene having a solubility parameter of 6.2.

11. The process according to claim 1, wherein step (a) is performed in the presence of a sulfur acid as a polycondensation catalyst.

12. The process according to claim 11, wherein the sulfur acid is an organic sulfur acid.

13. The process according to claim 12, wherein the organic sulfur acid has a surface activating effect.

14. The process according to claim 13, wherein the organic sulfur acid is selected from the group consisting of sulfonic acids having alkyl or aralkyl groups, sulfuric acid esters having alkyl or aralkyl groups, and salts thereof.

* * * * *